US006160342A

United States Patent [19]

Nishikawa et al.

[11] Patent Number: 6,160,342

[45] Date of Patent: Dec. 12, 2000

[54] RESISTOR-INCORPORATED SPARK PLUG AND MANUFACTURING METHOD OF RESISTOR-INCORPORATED SPARK PLUG

[75] Inventors: Kenichi Nishikawa; Yutaka Tanaka; Toshitaka Honda; Makoto Sugimoto, all of Aichi, Japan

[73] Assignee: NGK Spark Plug Co., Ltd., Nagoya, Japan

[21] Appl. No.: 09/064,002

[22] Filed: Apr. 21, 1998

[30] Foreign Application Priority Data

| | | | |
|---|---|---|---|
| Apr. 23, 1997 | [JP] | Japan | 9-105490 |
| Apr. 24, 1997 | [JP] | Japan | 9-106975 |
| Apr. 24, 1997 | [JP] | Japan | 9-107141 |
| Sep. 5, 1997 | [JP] | Japan | 9-257542 |
| Dec. 12, 1997 | [JP] | Japan | 9-362693 |
| Mar. 30, 1998 | [JP] | Japan | 10-104158 |

[51] Int. Cl.[7] ..... H01J 13/20

[52] U.S. Cl. ..... 313/141; 313/137; 313/136; 313/140

[58] Field of Search ..... 313/141, 142, 313/143, 140, 136, 137

[56] References Cited

U.S. PATENT DOCUMENTS

| | | | |
|---|---|---|---|
| 2,926,275 | 2/1960 | Péras | 313/137 |
| 3,235,655 | 2/1966 | Counts et al. | 313/136 |
| 3,538,021 | 11/1970 | Achey | 252/510 |
| 4,001,145 | 1/1977 | Sakai et al. | 252/513 |
| 4,795,944 | 1/1989 | Stimson | 313/136 |
| 5,008,584 | 4/1991 | Atsumi . | |
| 5,852,340 | 12/1998 | Ito et al. | 313/141 |
| 5,859,491 | 1/1999 | Nishikawa et al. | 313/141 |

FOREIGN PATENT DOCUMENTS

| | | | |
|---|---|---|---|
| 61-104580 | 5/1986 | Japan | H01T 13/20 |
| 61-253786 | 11/1986 | Japan | H01T 13/20 |
| 02126584A | 5/1990 | Japan | H01T 13/20 |

OTHER PUBLICATIONS

Japaneses Industrial Standard Testing Methods of Carbon Black for Rubber Industry 1982.

*Primary Examiner*—Vip Patel
*Assistant Examiner*—Mariceli Santiago
*Attorney, Agent, or Firm*—Snider & Associates; Ronald R. Snider

[57] ABSTRACT

In a spark plug (100), the resistor composition constituting a resistor (15) contains semiconductive ceramic particles, offering a superior load life characteristic. Also, the value of $(\alpha 2-\alpha 1)/\alpha 1 >= -0.30$, where a value of electric resistance between a terminal (13) and a center electrode (3) is $\alpha 1$ at 20° C. and $\alpha 2$ at 150° C., so that deterioration of the radio frequency noise prevention performance at high temperatures can be effectively suppressed. The resistor composition contains semiconductive ceramic particles whose temperature coefficient of electric resistance shows a positive value, or a negative value of relatively small absolute value, (e.g., $TiO_2$ particles having a rutile type crystalline structure, titanate or zirconate of alkali earth metal elements, titanium suboxide, etc.), or titanium metal. Thus, the invention provides a resistor-incorporated spark plug which is enabled to offer a stable load life characteristic even when a high load acts thereon, and which is unlikely to deteriorate in the radio frequency noise prevention performance even under high temperatures.

25 Claims, 7 Drawing Sheets

RESISTOR-INCORPORATED SPARK PLUG AND MANUFACTURING METHOD OF RESISTOR-INCORPORATED SPARK PLUG

BACKGROUND OF THE INVENTION

This application claims the priority of Japanese Patent Applications No. H9-105490 filed on Apr. 23, 1997, H9-106975 filed on Apr. 24, 1997, H9-107141 filed on Apr. 24, 1997, H9-257542 filed on Sep. 5, 1997 and H9-362693 filed on Dec. 12, 1997, and Japanese Patent Application filed on Mar. 30, 1998 with the title of the invention of "Resistor-Incorporated Spark Plug, Resistor Composition for Spark Plug and Manufacturing Method of Resistor-Incorporated Spark Plug", which are incorporated herein by reference.

The present invention relates to spark plugs to be used for internal combustion engines and, more particularly, to a spark plug into which a resistor for prevention of occurrence of radio frequency noise is incorporated and the manufacturing method thereof.

As this type of spark plug, there has conventionally been known one having a structure that a terminal is fixed in one end portion of a through hole formed along the axial direction of an insulator while a center electrode is similarly fixed in the other end portion of the through hole, where a resistor is placed between the terminal and the center electrode within the through hole. This resistor is implemented by one which is formed through steps of mixing amorphous carbon (e.g., carbon black) into glass powder and/or dielectric ceramic powder and thereafter sintering the mixture by hot press or the like as shown in Japanese Patent Laid-Open Publication S61-104580, S61-253786, or H2-126584.

In this connection, recently internal combustion engines such as automobile engines are on the trend toward higher output, while power supply ability has been on the increase for improvement of ignitionability. Also, with the downsizing of internal combustion engines, resistor-incorporated spark plugs have also been required to be smaller in size and higher in performance. Under these circumstances, there is an issue that when some high load is applied on such a resistor-incorporated spark plug, particularly on a small-size spark plug with a small-diameter resistor, the carbon that imparts electrical conductivity to the resistor would burn, causing the resistance value to increase, so that a stable load life characteristic could not be obtained.

SUMMARY OF THE INVENTION

An object of the present invention is to provide a resistor-incorporated spark plug, as well as a manufacturing method therefor, which is enabled to offer a stable load life characteristic even when a high load is applied thereon, and also to provide a resistor composition to be used for the resistor-incorporated spark plug.

Resistor-incorporated spark plugs according to the present invention have the following common structure in their essential part. That is, with respect to a through hole formed along an axis of an insulator, a terminal is fixed to one end side of the through hole while a center electrode is fixed to the other end side of the through hole, and a resistor made of a resistor composition principally comprising a conductive material, glass particles and ceramic particles other than glass is placed between the terminal and the center electrode within the through hole. Further, in a first constitution of the resistor-incorporated spark plug of the present invention, the resistor composition contains, as the ceramic particles, semiconductive ceramic particles, and $(a2-\alpha1)/\alpha1 \geqq -0.30$ where a value of electric resistance measured by making conduction between the terminal and the center electrode via the resistor is $\alpha1$ at 20° C. and $\alpha2$ at 150° C.

In an attempt to improve the load life characteristic of the spark plug, proposals for stabilizing the load life of the resistor by blending $TiO_2$ particles, which is a semiconductor oxide, in the resistor have been disclosed, for example, in Japanese Patent Laid-Open Publications S58-102480, S58-102481, S58-189917, S59-17201, S59-17202, S60-150601, S60-150602 and Japanese Patent Publication H5-52641. However, with higher output of an internal combustion engine, the spark plug used as it is attached to the internal combustion engine may increase in temperature so that the resistor built in the spark plug also increases in temperature, for example, to as high as about 100–300° C. When such a state occurs, the electric resistance of the semiconductive $TiO_2$, and moreover the specific electrical resistivity of the resistor, decreases so that the radio frequency noise prevention performance (radio frequency noise performance) is impaired, as a disadvantage.

Therefore, according to the first constitution of the invention, in the spark plug in which semiconductive ceramic particles are blended in the resistor, a condition of $(\alpha2-\alpha1)/\alpha1 \geqq -0.30$ is satisfied, where the value of electric resistance measured by making conduction between the terminal and the center electrode via the resistor is $\alpha1$ at 20° C. and $\alpha2$ at 150° C. By this setting, enough radio frequency noise prevention performance can be obtained even at high temperatures. In addition, if $(\alpha2-\alpha1)/\alpha1 < -0.30$, then the noise prevention performance at high temperatures may become insufficient. It is more preferable to satisfy that $(\alpha2-\alpha1)/\alpha1 \geqq -0.27$.

Next, it is possible that the resistor composition contains, as the semiconductive ceramic particles, 0.5–20 weight % of $TiO_2$ particles whose mean particle size of a particle image obtained from observation of its cross-sectional structure falls within a range of 0.5–20 $\mu$m, the $TiO_2$ particles at least partly having a rutile type crystalline structure. It is noted that although every metal oxide herein is represented by a composition formula having a stoichiometric composition, there are some cases actually where the metal oxide becomes a nonstoichiometric composition due to oxygen deficiency.

With this constitution, a successful load life characteristic can be ensured even under a high load condition by 0.5–20 weight % of $TiO_2$ particles being contained in the resistor composition. Further, by adjusting the mean particle size of the $TiO_2$ particles to be blended in the resistor composition within a range of 0.5–20 $\mu$m so that the $TiO_2$ particles at least partly have a rutile type crystalline structure, high-temperature deterioration of the radio frequency noise prevention performance by the resistor can be effectively suppressed.

For example, when the resistor contains $TiO_2$ particles and a non-metallic conductive material such as carbon particles, its conduction path is formed by contact between non-metallic conductive material particles themselves, between non-metallic conductive material and $TiO_2$ particles or between $TiO_2$ particles themselves. Besides, it is considered that the electric resistance value of the resistor can be expressed by a sum of intrinsic resistance (bulk resistance) of these particles and contact resistance between the particles.

In this connection, as a result of the present inventors' energetic researches, it was found out that the temperature dependency of a resistor as described above is ruled mainly by temperature variation in the intrinsic resistances of the individual particles. Meanwhile, $TiO_2$ has been known to have three types of crystalline structures under atmospheric pressure phase, the rutile type of the tetragonal system, anatase type of the tetragonal system and brookite type of the rhombic system. Among these, the two types of the rutile type and the anatase type are of industrial importance. The above constitution of the present invention has been completed by focusing on the fact that, in these two types of $TiO_2$ the rutile type results in smaller temperature variations of specific resistance than the anatase type.

If the content of $TiO_2$ particles in the resistor composition is less than 0.5 weight %, then the resistor becomes insufficient in load life characteristic. If it exceeds 20 weight %, its noise prevention performance is more likely to deteriorate due to high temperature. It is preferable to adjust the content of $TiO_2$ particles in the resistor composition desirably to 2–20 weight %, and more desirably to 3–15 weight %.

It can be generally said for $TiO_2$ that the anatase type crystalline structure tends to become more stable with decreasing particle size. Besides, if the mean particle size of $TiO_2$ particles is less than 0.5 $\mu$m, then the noise prevention performance by the resistor becomes more likely to deteriorate due to high temperature, which leads to a deterioration in temperature characteristic of the noise prevention performance. This could be attributed to the fact that the $TiO_2$ particles contained are formed into finer particles so that the relative content of the anatase type phase increases and, in turn, the relative content of the rutile type phase lacks, thus resulting in insufficient temperature characteristic of the noise prevention performance. As another problem, if the mean particle size of $TiO_2$ particles is less than 0.5 $\mu$m, then the bulk density of $TiO_2$ raw material powder increases so that the density of the resistor obtained by firing becomes insufficient, which leads to impairment of the noise prevention performance or load life characteristic. On the other hand, if the mean particle size of $TiO_2$ particles exceeds 20 $\mu$m, then the raw material powder particles of the resistor including not only $TiO_2$ powder but also later-described glass powder and ceramic powder other than $TiO_2$ become less easy to rearrange in the firing process, which leads to insufficient density of the resistor as well. The mean particle size of the $TiO_2$ particles in the resistor composition is preferably adjusted within a range of, more desirably, 2–8 $\mu$m.

Next, desirably, 20 weight % or more of the $TiO_2$ particles in the resistor composition have the rutile type crystalline structure (rutile type phase). In this case, the rest of the $TiO_2$ particles may be those having the anatase type crystalline structure (anatase type phase). If the content ratio of the rutile type phase occupying in the total amount of $TiO_2$ is less than 20 weight %, then temperature characteristic of the noise prevention performance may become insufficient. The content ratio of the rutile type phase is more desirably not less than 30 weight %. It is also preferable to adjust the content ratio of the rutile type phase to not more than 80 weight %. The rutile type phase being generally coarser than the anatase type phase, if the content ratio of the rutile type phase exceeds 80 weight %, then the conduction path forming part formed in the resistor principally of $TiO_2$, later-described metallic phase or non-metallic conductive material becomes non-uniform so that a stable load life characteristic cannot be obtained in some cases. The content ratio of the rutile type phase is, more desirably, not more than 70 weight %.

Also, with regard to its particle size distribution, it is preferable in terms of ensuring stable load life characteristic and noise prevention performance that a content ratio of the $TiO_2$ particles belonging to a particle size range of 0.05–0.5 $\mu$m is 20–80 weight %, and a content ratio of the $TiO_2$ particles belonging to a particle size range of 2–8 $\mu$m is 80–20 weight %. That is, the $TiO_2$ particles belonging to the particle size range of 2–8 $\mu$m are, in most part, those mainly having the rutile type phase, where its content ratio of 20 weight % or more makes it possible to attain a good temperature characteristic of the noise prevention performance. Further, when the content ratio of $TiO_2$ particles belonging to the particle size range of 2–8 $\mu$m is not more than 80 weight %, and when the content ratio of $TiO_2$ particles belonging the particle size range of 0.05–0.5 $\mu$m is adjusted to the aforementioned range, the conduction path forming part in the resistor can be made uniform in thickness so that a stable load life characteristic can be obtained. In addition, the content ratio of $TiO_2$ particles belonging to the particle size range of 0.05–0.5 $\mu$m is more desirably 30–70 weight %, and the content ratio of $TiO_2$ particles belonging to the particle size range of 2–8 $\mu$m is more desirably 70–30 weight %.

Next, the resistor composition may contain, as the semiconductive ceramic particles, 0.5–20 weight % of at least either one of a semiconductive titanate base complex oxide and a semiconductive zirconate base complex oxide (hereinafter, referred to as specific complex oxide when generically designated).

This constitution has been completed by focusing on the fact that both titanate base complex oxide and zirconium base complex oxide are small in intrinsic resistance variation with temperature, as compared with $TiO_2$ that has conventionally been used as the semiconductive ceramic particles. Then, a successful load life characteristic can be ensured even under a high load condition by 0.5–20 weight % of $TiO_2$ particles being contained in the resistor composition and besides high-temperature deterioration of the noise prevention performance by the resistor can be effectively suppressed.

If the content of the specific complex oxide in the resistor composition is less than 0.5 weight %, then the resistor becomes insufficient in load life characteristic. If it exceeds 20 weight % its noise prevention performance is more likely to deteriorate due to high temperature. It is preferable to adjust the content of the specific complex oxide in the resistor composition desirably to 2–20 weight %, and more desirably to 3–15 weight %.

As the aforementioned specific complex oxide, titanates of alkaline-earth metal elements or zirconates of alkaline-earth metal elements are particularly preferably usable for the present invention by virtue of their having successful semiconductor characteristics and their small variations in specific resistance with temperature.

Such titanates or zirconates of alkaline-earth metal elements can be exemplified by magnesium titanate (composition formula: $MgTiO_3$, which however may be a nonstoichiometric composition due to oxygen deficiency, also for the following), magnesium zirconate (composition formula: $MgZrO_3$), calcium titanate (composition formula: $CaTiO_3$), calcium zirconate (composition formula: $CaZrO_3$), strontium titanate (composition formula: $SrTiO_3$), strontium zirconate (composition formula: $SrZrO_3$), barium titanate (composition formula: $BaTiO_3$) and barium zirconate (composition formula: $BaZrO_3$). For the present invention, one kind or more selected from among these may used singly or in combination.

It is preferable that the mean particle size of particles of the specific complex oxide in the resistor composition is adjusted within a range of 0.5 μm–20 μm. If the mean particle size is less than 0.5 μm, then the bulk density of the specific complex oxide raw material powder increases so that the density of the resistor obtained by firing lacks, which may impair the noise prevention performance or the load life characteristic. On the other hand, if the mean particle size of the specific complex oxide exceeds 20 μm, then the raw material powder particles of the resistor including not only the specific complex oxide but also later-described glass powder and ceramic powder other than the specific complex oxide become less easy to rearrange in the firing process, which may resulting in insufficient density of the resistor as well. The mean particle size of the specific complex oxide in the resistor composition is preferably adjusted within a range of, more desirably, 2–8 μm.

In the above constitution, it is preferable that content of a remainder of the ceramic particles from which the $TiO_2$ particles or the specific complex oxide particles (hereinafter, referred to as auxiliary ceramic particles) is 2–32 weight %. If the content of the auxiliary ceramic particles falls outside the above range, the load life characteristic of the spark plug may be impaired. The content of the auxiliary ceramic particles is desirably adjusted within a range of 3–20 weight %. The auxiliary ceramic particles may be those composed principally of, for example, one kind or more selected from a group of $ZrO_2$, $ZrSiO_4$, $Al_2O_3$, MgO, Al-Mg spinel and mullite.

The resistor composition may be one which contains 2–90 weight % of glass, 2.5–52 weight % of ceramic particles (including $TiO_2$ particles or specific complex oxide) and 0.1–5 weight % of carbon component. Such a resistor composition can be obtained, for example, by preparing a raw material powder through the steps of mixing 2–90 weight % of glass powder, 2.5–52 weight % of ceramic particles, a non-metallic conductive material (e.g., carbon black) and 0.1–5 weight % of organic binder (e.g., PVA) plus, as required, an appropriate amount of metal powder (which results in a metallic phase), and heating and molding this raw material powder.

More specifically, the resistor composition can be produced by blending and hot pressing 3–20 weight % of glass particles having a mean particle size of less than 150 μm (hereinafter, referred to as fine particles), 60–90 weight % of glass particles belonging to a particle size range of 150–800 μm (hereinafter, referred to as coarse-particle glass), 0.5–20 weight % of $TiO_2$ particles or specific complex oxide particles, 2–32 weight % of auxiliary ceramic particles, 0.05–0.5 weight % of a metal powder composed principally of one kind or more selected from a group of Al, Mg, Ti, Zr and Zn (which forms a metallic phase) and 0.5–5.0 weight % of non-metallic conductive material powder.

FIG. 4 schematically shows the structure of the above resistor composition obtained in this way. That is, at least part of the fine-particle glass is melted and then solidified to form a binding glass phase, into which the metallic phase and the non-metallic conductive material particles (hereinafter, referred to generically as conductive material powder), thus forming a conduction path forming part. The conduction path forming part forms a so-called block structure, surrounding block glass particles which originate from the coarse-particle glass. In this case, at least part of the binding glass phase forms a continuous portion which ranges from the terminal-side end portion on the center-electrode-side end portion, where the continuous portion forms the conduction path of the resistor based on electrical contact between particles themselves of the conductive material powder. This continuous portion, or conduction path, is bypassed all over by the intervention of the block particles so that its effective length is elongated, by which a successful radio frequency noise prevention effect can be achieved.

The fine-particle glass at least partly melts during the hot press process, playing a role of filling gaps formed between the particles themselves of the fine-particle glass powder. However, if its particle size exceeds 150 μm, the fine-particle glass melts insufficiently so that voids tend to occur to the conduction path, which leads to impairment of the load life characteristic of the spark plug. In addition, it is preferable to set the particle size of the fine-particle glass powder within a range of, desirably, not more than 100 μm. In the case of the coarse-particle glass, on the other hand, if its particle size is less than 150 μm, the particles becomes more likely to soften or melt during the heating and molding process, so that the aforementioned block structure is impaired, making it impossible to achieve a successful noise prevention effect. Also, if the particle size exceeds 800 μm, voids are more likely to remain among the glass particles, which leads to impairment of the load life characteristic of the spark plug.

Further, if the weight of the fine-particle glass is less than 3 weight %, or if the weight of the coarse-particle glass exceeds 90 weight %, then the glass comes to hardly melt during the hot press process, so that a great deal of voids are formed between glass particles, causing an impairment of the load life characteristic. On the other hand, if the weight of the fine-particle glass exceeds 30 weight %, or if the weight of the coarse-particle glass is less than 90 weight %, then the content ratio of the block particles decreases so that the formation of the block structure becomes insufficient, making it impossible to achieve a successful radio frequency noise prevention effect. In addition, it is preferable to set the weight of the fine-particle glass within a range of, desirably, 3–12 weight %. Also, it is preferable to set the weight of the coarse-particle glass within a range of, desirably, 70–85 weight %.

If the blending amount of the metallic phase or the non-metallic conductive material deviates from the upper limit value of the above range, there are some cases where the radio frequency noise prevention effect becomes insufficient. Conversely, if it deviates from the lower limit value, there are some cases where the load life characteristic is impaired. The blending amount of the metallic phase is preferably adjusted within a range of, desirably, 0.1–0.3 weight %, and the blending amount of the non-metallic conductive material is preferably adjusted within a range of, desirably, 0.5–3.0 weight %.

Also, from the viewpoint of structure, the resistor composition is preferably constituted as follows. That is, the resistor composition comprises: 50–90 volume % of block glass particles comprising particles belonging to a particle size range of 150–180 μm; and 10–50 volume % of conduction path forming part which contains the conductive material, the ceramic particles and a binding glass phase for binding the conductive material and the ceramic particles with each other in their dispersed state, and which has such a form as to fill gaps among the block glass particles, and further which forms a conduction path within the resistor.

If the content ratio of the block glass particles is less than 50 volume %, or if the content ratio of the conduction path forming part itself in the resistor composition exceeds 50 volume %, then the formation of the block structure becomes insufficient so that a successful radio frequency noise prevention effect cannot be achieved. Conversely, if the content ratio of the block glass particles exceeds 90 volume %, or if the content ratio of the conduction path forming part itself in the resistor composition is less than 10 volume %, then a great deal of voids are formed between the glass particles, causing an impairment of the load life characteristic of the spark plug. It is preferable that the content ratio of the block glass particles is adjusted within a range of, more desirably, 20–40 volume %.

It is noted that the particle size of block glass particles is defined as a maximum value d of the distance between two parallel lines A, B, as shown in FIG. 8, where the parallel lines A, B are drawn, with respect to an outline of a particle on a resistor cross section, so as to be tangential to the outline and not to cross the inside of the particle, in various patterns by varying the positional relation with the particle (the case is similar also to the particle size of $TiO_2$ particles and the like as described before). Then, the volume content ratio of the block glass particles can be calculated by dividing the total area of the block glass particles observed on the resistor cross section by the field-of-view area.

The conductive material contained in the conduction path forming part may contain, for example, a metallic phase principally comprising one kind or more selected from among Al, Mg, Ti, Zr and Zn, and a non-metallic conductive material.

Also, the conduction path forming part may contain 7.5–50 weight % of the binding glass phase, 0.1–3.0 weight % of the metallic phase, 1.2–12.5 weight % of the non-metallic conductive material, 5–80 weight % of ceramic particles in which the $TiO_2$ particles or the specific complex oxide particles occupy 5–50 weight %, on a basis of weight content ratio occupying in the conduction path forming part.

If the content ratio of the binding glass phase in the conduction path forming part is less than 7.5 weight %, then the glass comes to hardly melt during the hot press process, so that a great deal of voids are formed between glass particles, causing an impairment of the load life characteristic of the spark plug. On the other hand, if it exceeds 50 weight %, then the relative ratio of the metallic phase or the non-metallic conductive material decreases, which leads to an impairment of the load life characteristic. Also, if the content ratio of the metallic phase or the non-metallic conductive material particles in the conduction path forming part deviates from the upper limit value of the above range, the radio frequency noise prevention effect becomes insufficient in some cases. Conversely, if it deviates from the lower limit value, the load life characteristic is impaired in some cases.

Further, if the content ratio of the $TiO_2$ particles or the specific complex oxide particles in the conduction path forming part is less than 5 weight %, then the resistor becomes insufficient in load life characteristic. If it exceeds 50 weight %, its noise prevention performance is more likely to deteriorate due to high temperature. In this case, the volume ratio of the $TiO_2$ particles or the specific complex oxide particles occupying in the conduction path forming part is preferably adjusted within a range of 5–50 volume %, desirably, of 20–40 volume % because of the same reasons. In addition, this volume ratio VR can be calculated, for example, by the following equation:

$$VR=\{S0\times V1/(V1+V2)\}\times 100 \text{ (volume \%)} \quad (1)$$

where S0 is the area ratio of ceramic particles observed in a cross-sectional structure of the resistor composition, V1 is the volume of the $TiO_2$ particles or the specific complex oxide particles contained in the resistor composition identified by X-ray diffraction and V2 is the volume of the auxiliary ceramic particles determined likewise.

The non-metallic conductive material may be provided as one principally comprising one kind or more selected from the particles of amorphous carbon (carbon black), graphite, SiC, TiC, WC and ZrC. In this case, the resistor composition contains a carbon component based on the non-metallic conductive material, where the carbon component presents mainly in the conduction path forming part. For example when carbon black is used, at least part of the carbon component is contained in the conduction path forming part in the form of carbon black particles.

Preferably, the content of the carbon in the resistor composition is adjusted within a range of 0.5–5 weight %. If the carbon content is less than 0.5 weight %, then the load life characteristic of the spark plug is impaired in some cases. Also, if the carbon content exceeds 5 weight %, then the radio frequency noise prevention effect becomes insufficient in some cases. The carbon content is preferably adjusted within a range of, more desirably, 0.5–3 weight %. In addition, there are some cases where carbon components originating from organic binders for use of powder molding are contained in the non-metallic conductive material.

For the present invention, the material of the glass particles may be one containing one kind or more selected from a group of, for example, $B_2O_3$-$SiO_2$ based, BaO-$B_2O_3$ based, $SiO_2$-$B_2O_3$-CaO-BaO based, and $SiO_2$-ZnO-$B_2O_3$ based, $SiO_2$-$B_2O_3$-$Li_2O$ based, and $SiO_2$-$B_2O_3Li_2O$-BaO based glass powders. In this case, if a material having a softening temperature of not more than 800° C. is used, the glass is enhanced in its fluidity at the melting so that the binding glass phase spreads enough to the gaps between the block particles, making gaps or the like less likely to be formed. As a result, the load life characteristic of the spark plug is improved. It is noted here that the softening temperature of glass refers to a temperature at which its coefficient of viscosity is $4.5\times10^7$ poise. If the softening temperature is less than 300° C., heat resistance of the resistor is impaired. Therefore, it is preferable to use a glass material having a softening temperature of 300–800° C., more desirably, 600–800° C. In addition, different glass materials may be used between the coarse-particle glass (or block glass particles) and the fine-particle glass (or binding glass phase).

As to the softening temperature of glass, the softening point of the glass can be estimated through steps of analyzing the contents of oxidized element components such as B, Si, Ca, Ba and Li in the glass particles of the resistor, respectively, and calculating an oxide-equivalent composition, and obtaining a glass sample by blending, dissolving oxide raw materials for the individual element components to be oxidized so that the resulting composition becomes generally equal to the calculated composition, and thereafter quenching the raw material, where the softening point of the resulting glass sample is taken as the softening point of the relevant glass.

Also, desirably, the material of the glass particles is one whose difference between the softening temperature of the fine-particle glass and the softening temperature of the coarse-particle glass is not more than 100° C. That is, desirably, if the softening temperatures of the fine-particle glass and the coarse-particle glass are TF and TC, respectively, then $|TF-TC|<100°$ C. In this case, it is allowable that either TF>TC or TF<TC. The reason of this is given below.

In the first place, in comparison between fine-particle glass and coarse-particle glass, the former is more likely to be deformed in the hot press process than the latter even with the same coefficient of viscosity. Then, in the case where TF>TC, if |TF−TC|≦100° C., then even with the softening temperature of the fine-particle glass a little higher than that of the coarse-particle glass, the fine-particle glass is enough deformed by the pressure during the hot press so as to fill the gaps between the coarse-particle glass particles, allowing the load life characteristic of the spark plug to be held good. However, if |TF−TC|>100° C., then the fine-particle glass may be deformed only insufficiently so that gaps are formed between the coarse-particle glass particles, which may cause a deterioration of the load life characteristic. On the other hand, in the case where TF<TC, in which case the fine-particle glass is more likely to be deformed so that gaps are more unlikely to be deformed, if |TF−TC|>100° C., then the coefficient of viscosity of the glass becomes too low and besides voids due to foaming of the fine-particle glass are likely to occur to the conduction path forming part, which may cause a deterioration of the load life characteristic. Therefore, it is preferable that |TF−TC| is not more than 100° C., and more desirably not more than 50° C.

Next, the resistor composition may contain at least either one of a metallic phase principally comprising Ti as the conductive material (hereinafter, referred to as Ti-based metallic phase) and titanium suboxide particles represented by a composition formula of $Ti_nO_{2n-1}$ as the semiconductive ceramic particles. It is noted that titanium suboxide herein referred to is a titanium oxide having an oxygen content lower than titanium dioxide, and can also be represented by a composition formula of $TiO_x$(x<2).

The anatase type $TiO_2$ conventionally blended in the resistor composition is semiconductive and has a property that the electric resistance decreases with increasing temperature (i.e., having a negative temperature coefficient). In this case, because of a relatively large rate of change of the electric resistance due to temperature increase, the electric resistance at high temperatures decreases to a large extent so that excessively increasing the blending amount would cause the radio frequency noise prevention performance to be impair, as a disadvantage. In contrast to this, the aforementioned titanium suboxide, similarly semiconductive as it is, is smaller in the rate of change of electric resistance due to temperature increase than titanium dioxide, so that decrease in the electric resistance of the resistor at high temperatures is suppressed and, as a result, a successful radio frequency noise prevention performance can be ensured even at high temperatures. Further, the Ti-based metal increases in electric resistance with increasing temperature, conversely (i.e., having a positive temperature coefficient), and therefore is capable of producing the same effects for the suppression of resistance decrease at high temperatures as in the aforementioned titanium suboxide. Further, the Ti-based metallic phase and the titanium suboxide particles in the resistor composition act also as load life stabilizers, thus allowing an effect of improving the load life characteristic of the resistor to be achieved as well. In addition, the Ti-based metallic phase and the titanium suboxide may be contained in the resistor composition either singly, whichever it is, or in combination of both.

In this case, when the total content of the Ti-based metallic phase and/or the titanium suboxide particles in the resistor composition is adjusted to a range of 0.5–10 weight %, the aforementioned effect can be made even more remarkable. If the total content is less than 0.5 weight %, then the effect of suppressing resistance increase at high temperatures may be insufficient in some cases. Also, if the total content exceeds 10 weight %, excessive increase in the specific electrical resistivity of the resistor composition may be caused.

Preferably, the Ti-based metallic phase and/or the titanium suboxide particles is adjusted so as to have a mean particle size of 5 μm–100 μm. If the mean particle size is less than 5 μm, the Ti-based metallic phase and/or the titanium suboxide particles are more likely to progress in oxidation reaction during the production of the resistor, so that the effect of suppressing resistance increase at high temperatures becomes insufficient in some cases. On the other hand, if the mean particle size exceeds 100 μm, excessive increase in the specific electrical resistivity of the resistor composition may be caused in some cases. In addition, the mean particle size is preferably adjusted within a range of, desirably, 10–30 μm.

For the present invention, the titanium suboxide particles may principally comprise at least any one of TiO (cubic crystal system), $Ti_2O_3$ (hexagonal crystal system) and $Ti_3O_5$ (monoclinic crystal system). Out of these, $Ti_3O_5$ is particularly preferable for the present invention by virtue of its stability to humidity, atmosphere and the like. In addition, although composition formulas of various titanium suboxides are represented all by stoichiometric ratio, but they may become nonstoichiometric compositions due to oxygen deficiency in some cases.

The ceramic particles other than the titanium suboxide may be those composed principally of, for example, one kind or more selected from a group of $ZrO_2$, $ZrSiO_4$, $Al_2O_3$, MgO, Al-Mg spinel and mullite.

The resistor composition may comprises 2–60 weight % of glass, 2–65 weight % of the ceramic particles (including titanium suboxide), and 0.1–7 weight % of carbon component. Such a resistor composition can be obtained, for example, by preparing a raw material powder through the steps of mixing 2–60 weight % of glass particles, 2–65 weight % of ceramic particles (including titanium suboxide), 0.1–5 weight % of a non-metallic conductive material (e.g., carbon black) and 0.1–5 weight % of organic binder (e.g., PVA) plus, as required, an appropriate amount of metal powder (which results in a metallic phase), and molding and heating this raw material powder.

Specifically, the blending ratio of the raw material powder of the resistor composition is preferably as follows:

fine-particle glass: 0.5–20 weight %;

coarse-particle glass: 50–90 weight %;

Ti metal particles and/or titanium suboxide particles: 0.5–10 weight %;

auxiliary ceramic particles: 0.1–6 weight % and non-metallic conductive material particles: 0.5–7.0 weight %.

Also, from the viewpoint of structure, the resistor composition preferably comprises: 50–90 volume % of the aforementioned block glass particles and 10–50 volume % of the conduction path forming part. In addition, the conductive material particles contained in the conduction path forming part may contain a metallic phase principally comprising one kind or more selected from among Al, Mg, Ti, Zr and Zn, and a non-metallic conductive material.

Also, the volume ratio of the Ti-based metallic phase or the titanium suboxide particles occupying in the conduction path forming part is preferably adjusted to within a range of 5–50 volume %, desirably, 20–40 volume %. If the volume ratio is less than 5 volume %, then the resistor becomes insufficient in load life characteristic. If it exceeds 50 weight %, its noise prevention performance is more likely to deteriorate due to high temperature.

In this case also, the non-metallic conductive material particles may be amorphous carbon (carbon black), and besides graphite, SiC, TiC, WC, ZrC or the like. Preferably, the content of carbon in the resistor composition is adjusted within a range of 0.5–7.0 weight % as stated before. If the carbon content is less than 0.5 weight %, then the load life characteristic of the spark plug is impaired in some cases. Also, if the carbon content exceeds 7.0 weight %, then the radio frequency noise prevention effect becomes insufficient in some cases. The carbon content is preferably adjusted within a range of, more desirably, 2.0–5.0 weight %.

A second constitution of the resistor-incorporated spark plug is characterized in that the resistor composition contains at least one of TiC particles and TiN particles as a non-metallic conductive material.

The resistor of a spark plug is exposed to severe conditions such as high voltages and high temperatures and, as a result, progressively oxidizes as the time in use elapses. It is noted here that although the aforementioned carbon black has often been used as the non-metallic conductive material hereto, carbon black would change into CO or $CO_2$ and dissipate when oxidized, so that the resistance value may abruptly increase with progressing oxidation. However, using at least one of the TiC particles or the TiN particles in place of carbon black or together with carbon black offers the following advantage. That is, TiC or TiN will not dissipate even if oxidized, and yet forms semiconductive $TiO_2$ (or titanium suboxide), so that any abrupt increase in the resistance value can be suppressed. Further, TiC or TiN generally has a large particle size on the order of several $\mu$m (10 to 100 times that of carbon black particles), thus requiring a long time until it is completely oxidized. Therefore, a spark plug which is less in change with time of the resistor and superior in durability can be obtained.

In this case, the total content of the TiC particles and/or the TiN particles in the resistor composition is preferably set within a range of 1–10 weight %. If the total content is less than 1 weight %, then the absolute content of conductive material lacks so that an increase in the initial resistance value may be incurred. Also, because of a thinned conduction path, the load per unit area becomes higher so that the durability may deteriorate. On the other hand, if the total content exceeds 10 weight %, the initial resistance value becomes too low so that the expected radio frequency noise prevention performance could no longer be obtained.

When the TiC particles and/or the TiN particles in the resistor composition have a mean particle size of not more than 5 $\mu$m in a particle image obtained from observation of its cross-sectional structure, enough specific surface area of the TiC particles and/or TiN particles per unit area of the resistor can be ensured so that variation with time in the resistance value is lessened and the durability of the resistor can be improved. Furthermore, it becomes easy to adjust the resistance value of the resistor to the expected target value.

Further, oxygen content of the TiC particles and/or the TiN particles is preferably not more than 3 weight %. In other words, TiC particle and/or TiN particles, which serve as the starting material of the resistor composition, are preferably those having an oxygen content of not more than 3.0 weight %. If the oxygen content exceeds 3.0 weight %, then the oxygen concentration at surface layer portions of the particles increases so that the contact resistance between particles themselves becomes high, which may cause a deterioration of the durability of the resistor.

The resistor composition may contain 20–80 weight % of glass, and 2–60 weight % of the ceramic particles. Such a resistor composition can be obtained, for example, by preparing a raw material powder through the steps of mixing 1–10 weight % of TiC particles and/or TiN particles, 20–80 weight % of glass powder, 2–60 weight % of ceramic powder, 0.5–5 weight % of organic binder (e.g., PVA) plus, as required, an appropriate amount of metal powder (which results in a metallic phase) or a non-metallic conductive material (e.g., carbon black) other than the TiC particles and/or TiN particles, and heating and molding this raw material powder.

In this case, specifically, the blending ratio of the raw material powder of the resistor composition is preferably as follows:

fine-particle glass: 0.5–20 weight %;

coarse-particle glass: 50–90 weight %;

ceramic particles: 2–60 weight % and non-metallic conductive material particles (including TiC particles and/or TiN particles): 1–10.0 weight %.

Also, from the viewpoint of structure, the resistor composition preferably comprises: 50–90 volume % of the aforementioned block glass particles and 10–50 volume % of the conduction path forming part. In addition, the conductive material contained in the conduction path forming part may contain a metallic phase principally comprising one kind or more selected from among Al, Mg, Ti, Zr and Zn, and the non-metallic conductive material.

Also, the volume ratio of the TiC particles and/or the TiN particles occupying in the conduction path forming part is preferably adjusted within a range of 5–50 volume %, desirably, 20–40 volume %. If the volume ratio is less than 5 volume %, then the resistor becomes insufficient in load life characteristic. If it exceeds 50 volume %, its noise prevention performance is more likely to deteriorate due to high temperature.

In addition, when a carbon base conductive material such as carbon black or graphite is blended in addition to the TiC particles and/or the TiN particles, it is preferable that the content of the carbon component in the resistor composition except those contained in the TiC particles is not more than 7.0 weight %. If this content exceeds 7.0 weight %, then the radio frequency noise prevention effect may become insufficient in some cases.

Next, a third constitution of the spark plug as well as a process for manufacturing the same according to the present invention are characterized in that a resistor composition constituting a resistor is fabricated by using a raw material powder which principally comprises glass particles, ceramic particles other than glass, and carbon black particles having a mean particle size of 20 nm–80 nm.

The carbon black intervenes is intervenient among the other raw material powder (glass, ceramic) particles in the resistor, and primary particles of the carbon black concatenate in a one-dimensional fashion to form concatenated structures. The resulting structures are further connected to one another, thus forming a conductive network of the resistor.

When the raw material powder of the resistor is prepared by wet mixing with the use of an aqueous medium, carbon black is poor in dispersibility because of the factors such as low wettability with water of large specific gravity. In particular, when the carbon black is small in particle size or long in structure, it becomes difficult to obtain a uniform distribution of carbon black. As a result, the carbon black is maldistributed in the resistor composition, causing a problem that when glass is sealed with this resistor composition, the resulting resistor is varied in resistance value and besides the conduction path is localized with the result of concentrated current densities, hence an unstable load life characteristic of the spark plug. On the other hand, when the carbon black is too large in particle size or short in structure, the conductivity decreases so that the blending amount of carbon black needs to be increased. However, because carbon black is far smaller in particle size than the other raw material powders such as glass and ceramic powders, excessive increase of the blending amount would cause the bulk density of the raw material powder to increase so that bridging of the powder particles or the like becomes more likely to occur, resulting in a loss of the compressibility. As a result, the resistor obtained would result in a lower density as well as an increased amount of defects such as voids, causing a problem of an unstable load life characteristic of the spark plug.

The present inventors have energetically discussed in view of these standpoints, finding out that by using a carbon black having a mean particle size of 20 nm–80 nm, the resistor obtained can be made less in variation of resistance value and the spark plug using this resistor can be stabilized in load life characteristic.

It is due to the following reason that the mean particle size of the carbon black is restricted to the range of 20–80 nm. First, a mean particle size of 20 nm or more allows the carbon black to be uniformly distributed into the resistor composition, so that variation in the resistance value of the resistor can be suppressed, and besides that the current path is dispersed, making the concentration of current densities unlikely to occur. On the other hand, a mean particle size of 80 nm or less makes it possible to obtain a successful conductivity even with a reduced blending amount of the carbon black. As a result, the amount of use of carbon black, which is finer as compared with the other raw material powders, can be reduced so that the bulk density of the raw material powder for the resistor composition can be enhanced, with the results that the resistor finally obtained is enhanced in density and moreover that a resistor less in defects and stable load life characteristic can be obtained. In addition, the mean particle size of carbon black is preferably within a range of, desirably, 30–50 nm.

In this case, preferably, the carbon black powder is a powder whose amount of DBP (dibutylphthalate) absorbed by 100 g of carbon black as defined in A process of Japanese Industrial Standard K6221, 6.1.2 is 60–120 ml. This amount of DBP absorption, which increases with increasing structure length in the carbon black powder, can be used as an index that reflects the structure length (hereinafter, the amount of DBP absorption measured by this process will be referred to as "structure length".)

Then, when the structure length of carbon black is not more than 120 ml/100 g, the structure can be uniformly distributed into the resistor and the current path is dispersed, making the concentration of current densities unlikely to occur. On the other hand, when the structure length is not less than 60 ml/100 g, it becomes possible to obtain a successful conductivity with a less blending amount of carbon black, so that the amount of use of carbon black is reduced and that the bulk density of the raw material powder for the resistor composition can be enhanced. As a result, the resistor finally obtained is improved in density so that a resistor less in defects and stable in load life characteristic can be obtained. In addition, preferably, the structure length is within a range of, desirably, 80–100 ml/100 g.

In this case, preferably, the raw material powder of the resistor composition comprises 20–90 weight % of glass powder, 20–50 weight % of ceramic powder, 5–30 weight % of carbon black powder, and 0.05–5 weight % of an organic binder. If the blending amount of glass powder is less than 20 weight %, then it may be impossible to ensure a successful sealability. On the other hand, if it exceeds 90 weight %, then the load life characteristic may become insufficient. The blending amount of glass powder is preferably within a range of 70–80 weight %. Meanwhile, if the amount of ceramic powder is less than 20 weight % or if the amount of carbon black powder is less than 5 weight %, the conduction path may become excessively thin so that a deterioration of the load life may be incurred. Also, if the amount of ceramic powder exceeds 50 weight % or if the amount of carbon black exceeds 30 weight %, then a deterioration of radio frequency noise prevention performance results. In addition, preferably, the amount of the ceramic powder is within a range of 20–30 weight % and the amount of carbon black is within a range of 5–10 weight %.

For the resistor compositions of the present invention, it is preferable that the specific electrical resistivity at 20° C. is adjusted within a range of 50–2000 Ω.cm. If the value of specific electrical resistivity is less than 50 Ω.cm, then the noise prevention performance may become insufficient. Also, if the value of specific electrical resistivity exceeds 2000 Ω.cm, then the load life characteristic may become insufficient. The value of the specific electrical resistivity is preferably adjusted within a range of, more desirably, 100–1200 Ω.cm.

A fourth constitution of the resistor-incorporated spark plug according to the present invention is characterized in that the resistor composition contains, as the ceramic particles, 0.5–20 weight % of $TiO_2$ particles whose mean particle size of a particle image obtained from observation of its cross-sectional structure falls within a range of 0.5–20 μm, the $TiO_2$ particles in the resistor composition at least partly having a rutile type crystalline structure.

Further, a fifth constitution of the resistor-incorporated spark plug according to the present invention is characterized in that the resistor composition contains, as the ceramic particles, 0.5–20 weight % of at least either one of a semiconductive titanate base complex oxide and a semiconductive zirconate base complex oxide (specific complex oxide).

A sixth constitution of the invention is characterized in that the resistor composition contains at least either one of a metallic phase principally comprising Ti as the conductive material (hereinafter, referred to as Ti-based metallic phase) and titanium suboxide particles represented by a composition formula of $Ti_nO_{2n-1}$ as the ceramic particles.

DETAILED DESCRIPTION OF THE PREFERRED EMBODIMENTS

Hereinbelow, several embodiments of the present invention are described with reference to the accompanying drawings.

Figure 1:
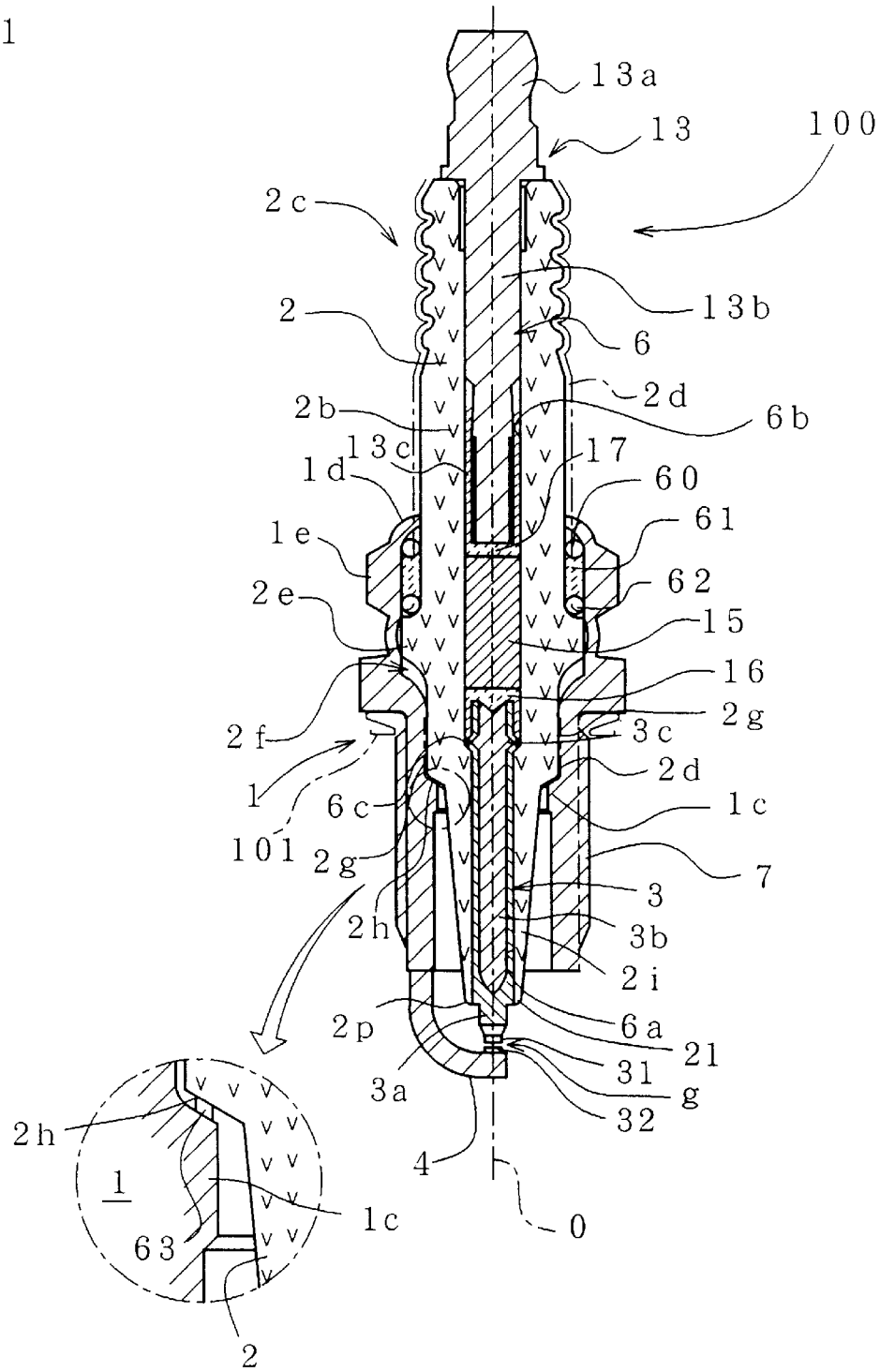
FIG. 1 is a general front cross-sectional view showing an example of the spark plug according to the present invention.
Figure 2:
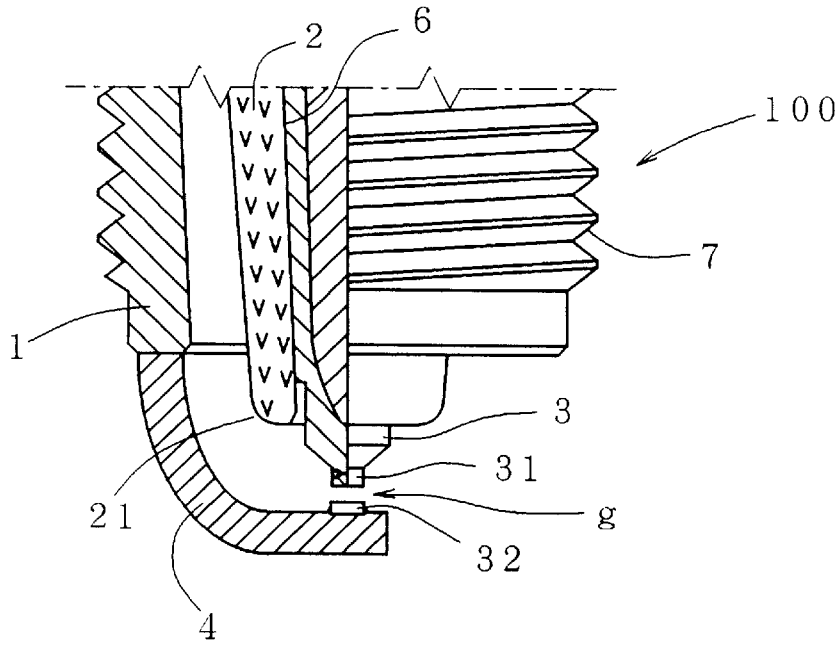
FIG. 2 is a partial front cross-sectional view of main part of FIG. 1.

A spark plug 100 which is an example of the present invention, as shown in FIGS. 1 and 2, comprises a cylindrical metallic shell 1, an insulator 2 fitted to the inside of the metallic shell 1 so that its tip end portion 21 is projected from the metallic shell, a center electrode 3 provided inside the insulator 2 in a state that an ignition portion 31 formed at the tip end is projected from the insulator, a ground electrode 4 one end of which is coupled to the metallic shell 1 by welding or the like while the other end is folded back sideways so that its one side face is opposed to the tip end portion of the center electrode 3, and the like. The ground electrode 4 has an ignition portion 32 formed opposite to the ignition portion 31, where a gap between the ignition portion 31 and its opposite ignition portion 32 serves as a spark gap g.

The metallic shell 1, which is cylindrically formed of a metal such as low carbon steel, serves as a housing of the spark plug 100 and has on its outer peripheral surface a threaded portion 7 for mounting the spark plug 100 to an unshown engine block. In addition, reference numeral 1*e* denotes a hex portion which allows a spanner, wrench or other tool to be engaged therewith in the process of mounting the metallic shell 1 to the engine block. The outer diameter of the threaded portion 7 is 10–18 mm (e.g., 10 mm, 12 mm, 14 mm, 18 mm).

The insulator 2 has a through hole 6 which allows the center electrode 3 to be fitted thereinto along its own axial direction. The insulator 2 is implemented, for example, by an alumina base ceramic sintered body which contains alumina, as the major component, and 85–95 weight % (desirably, 90–98 weight %) of Al component on the basis of $Al_2O_3$ equivalent weight.

Referring next to the through hole 6 formed axially of the insulator 2, a terminal 13 is inserted and fitted in one end portion of the through hole 6, while the center electrode 3 is inserted and fixed in the other end portion thereof. The terminal 13 is implemented by low carbon steel or the like, and its surface is coated with an anticorrosion Ni plated layer (layer thickness, e.g., 5 $\mu$m). The terminal 13 comprises a seal portion 13*c*, a terminal portion 13*a* projected from a rear end edge of the insulator 2, and a rod portion 13*b* for connecting the terminal portion 13*a* and the seal portion 13*c* to each other. It is noted that the seal portion 13*c* is machined at its outer peripheral surface into a screwed or knurled state, and its gap against the inner surface of the through hole 6 is sealed by a conductive glass seal layer 17.

Within the through hole 6, a resistor 15 is placed between the terminal 13 and the center electrode 3. Both end portions of this resistor 15 are electrically connected to the center electrode 3 and the terminal 13 via conductive glass seal layers 16, 17, respectively. The resistor 15 is formed from a resistor composition of the present invention. The conductive glass seal layers 16, 17 are formed from a glass mixed with a metal powder composed mainly of one kind or more than one kind of metal components such as Cu, Sn and Fe. In addition, in the conductive glass seal layers, an appropriate amount of semiconductor inorganic compounds such as $TiO_2$ may be blended as required.

As shown in FIG. 1, a projected portion 2*e* projected circumferentially outward is formed into, for example, a flange shape at an axially intermediate portion of the insulator 2. In the insulator 2, as its portion toward the tip end of the center electrode 3 (FIG. 1) is regarded as front side, a body portion 2*b* is formed on the rear side more than the projected portion 2*e* so as to be smaller in diameter than the projected portion 2*e*. Meanwhile, on the front side of the projected portion 2*e*, are formed a first stem portion 2*g* with diameter smaller than the projected portion 2*e* and a second stem portion 2*i* with diameter even smaller than the first stem portion 2*g*, in this order. In addition, a corrugation portion 2*c* is formed at a rear end portion of the outer circumferential surface of the body portion 2*b*. Also, the outer circumferential surface of the first stem portion 2*g* is made generally cylindrical, while the outer circumferential surface of the second stem portion 2*i* is made into a generally conical surface that decreases in diameter toward the tip end.

On the other hand, the stem cross-section diameter of the center electrode 3 is set smaller than the stem cross-section diameter of the resistor 15. Besides, the through hole 6 of the insulator 2 has a generally cylindrical first portion 6*a* which allows the center electrode 3 to be inserted therethrough, and a generally cylindrical second portion 6*b* which is formed on the rear side (upper side in the figure) of the first portion 6*a* so as to be larger in diameter than the first portion 6*a*. As shown in FIG. 1, the terminal 13 and the resistor 15 are housed in the second portion 6*b*, and the center electrode 3 is inserted in the first portion 6*a*. At a rear end portion of the center electrode 3, a protruded portion 3*a* for use of electrode fixation is formed so as to be protruded outward from the outer circumferential surface of the center electrode 3. The first portion 6*a* and the second portion 6*b* of the through hole 6 are connected to each other within the first stem portion 2*g*, and at their connecting position, a protruded-portion receiving surface 6*c* for receiving the electrode-fixing protruded portion 3*a* of the center electrode 3 is formed into a taper surface or rounded surface.

The outer circumferential surface of a connecting portion 2*h* between the first stem portion 2*g* and the second stem portion 2*i* is made into a stepped surface. This stepped surface is engaged via a ring-shaped plate packing 63 with a protrusive portion 1*c* serving as a metallic-shell side engaging portion formed at the inner surface of the metallic shell 1, by which axial loosening is prevented. On the other hand, between the inner surface of the rear-side opening of the metallic shell 1 and the outer surface of the insulator 2, is placed a ring-shaped wire packing 62 to be engaged with the rear-side peripheral edge of the flange-shaped projected portion 2*e*. Further behind, a ring-shaped packing 60 is placed via a talc or other filling layer 61. Then, the insulator 2 is pushed in forth toward the metallic shell 1, in which state the opening edge of the metallic shell 1 is caulked inward toward the packing 60 so that a caulked portion 1*d* is formed with the metallic shell 1 fixed to the insulator 2.

Figure 5A:
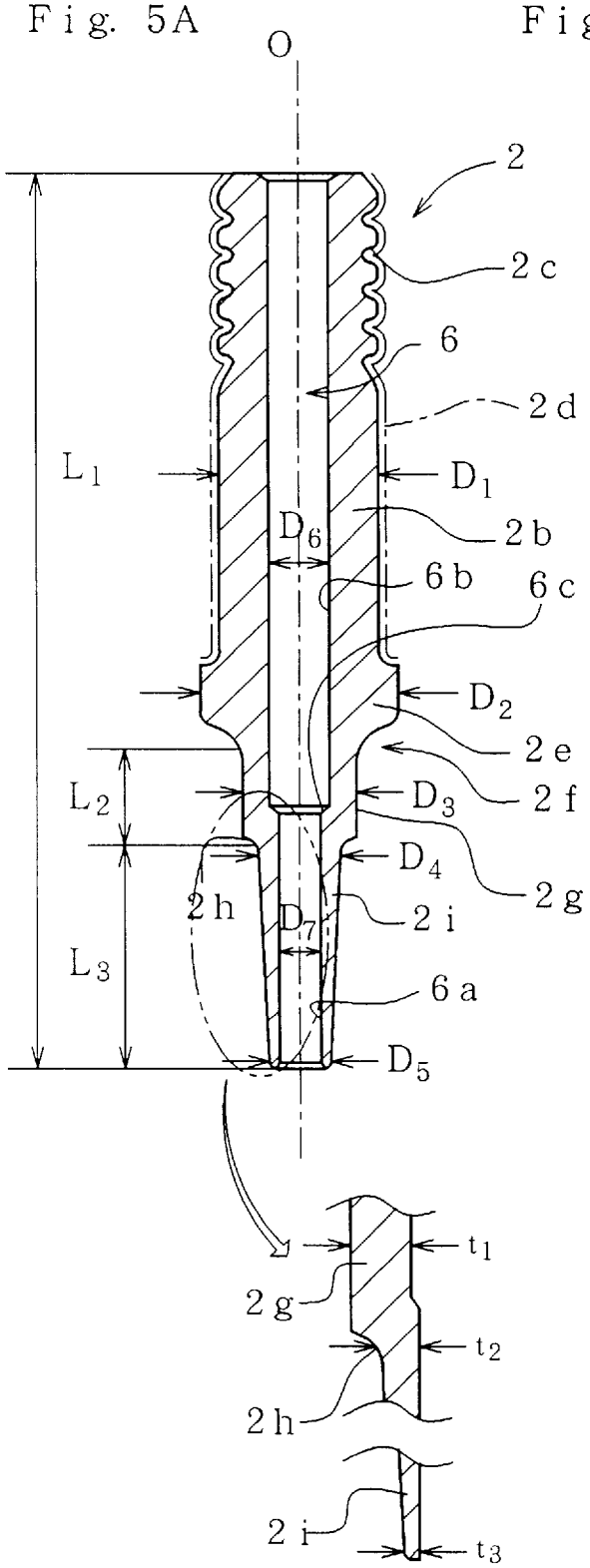
FIG. 5A is a longitudinal sectional view showing an example of the insulator.
Figure 5B:
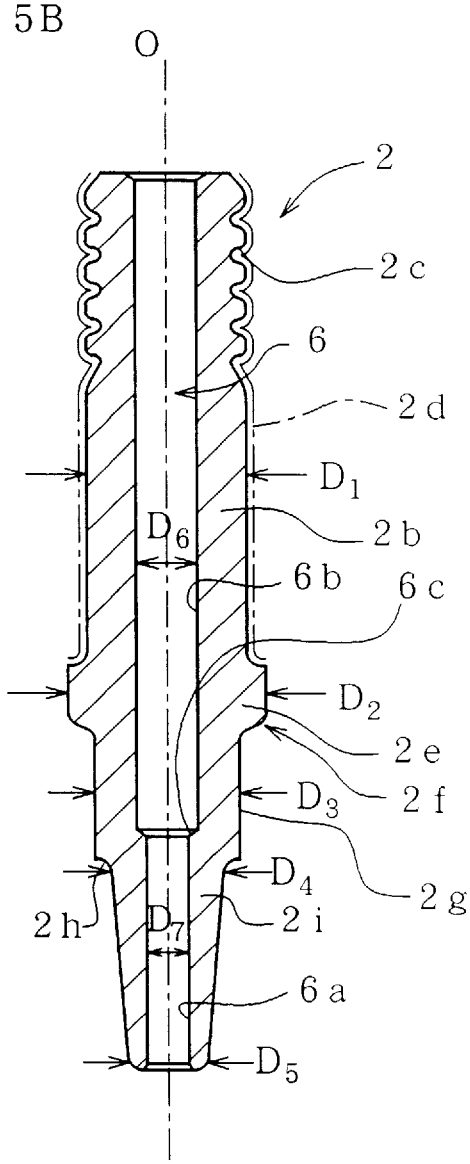
FIG. 5B is a longitudinal sectional view showing another example of the insulator.

FIGS. 5A and 5B show some examples of the insulator 2. Dimensions of their individual parts are given as examples:

Overall length L1: 30–75 mm,

Length L2 of first stem portion 2*g*: 0–30 mm (not including connecting portion 2*f* with projected portion 2*e*, but including connecting portion 2*h* with second stem portion 2*i*), Length L3 of second stem portion 2*i*: 2–27 mm, Outer diameter $D_1$ of body portion 2*b*: 9–13 mm, Outer diameter $D_2$ of projected portion 2*e* for engagement: 11–16 mm, Outer diameter $D_3$ of first stem portion 2*g* : 5–11 mm, Outer diameter $D_4$ of base end portion of second stem portion 2*i*: 3–8 mm, Outer diameter $D_5$ of tip end portion of second stem portion 2*i* (which, when the outer peripheral edge of tip end surface is rounded or chamfered, refers to the outer diameter at a base end position of the rounded portion or chamfered portion): 2.5–7 mm, Inner diameter $D_6$ of second portion 6*b* of through hole 6:2–5 mm, Inner diameter $D_7$ of first portion 6*a* of through hole 6: 1–3.5 mm, Wall thickness t1 of first stem portion 2*g*: 0.5–4.5 mm, Wall thickness t2 of base end portion of second stem portion 2*i* (a value in the direction perpendicular to center axis line O) 0.3–3.5 mm, Wall thickness t3 of tip end portion of second stem portion 2*i* (a value in the direction perpendicular to center axis line O; however, when the outer peripheral edge of tip end surface is rounded or chamfered, the value refers to the wall thickness at a base end position of the rounded portion or chamfered portion within a cross section including the center axis line O): 0.2–3 mm, and Average wall thickness tA of second stem portion 2*i* (=(t1+t2)/2): 0.25–3.25 mm.

Dimensions of the individual parts as designated above in an insulator 2 shown in FIG. 5A are, for example, as follows: L1=approx. 60 mm, L2=approx. 10 mm, L3=approx. 14 mm, $D_1$=approx. 11 mm, $D_2$=approx. 13 mm, $D_3$=approx. 7.3 mm, $D_4$=5.3 mm, $D_5$=4.3 mm, $D_6$=3.9 mm, $D_7$=2.6 mm, t1=3.3 mm, t2=1.4 mm, t3=0.9 mm, tA=1.2 mm.

In another insulator 2 shown in FIG. 5B, the first stem portion 2*g* and the second stem portion 2*i* have outer diameters slightly larger than those of the insulator 2 shown in FIG. 5A. Dimensions of the individual parts are, for example, as follows: L1=approx. 60 mm, L2=approx. 10 mm, L3=approx. 14 mm, $D_1$=approx. 11 mm, $D_2$=approx. 13 mm, $D_3$=approx. 9.2 mm, $D_4$=6.9 mm, $D_5$=5.1 mm, $D_6$=3.9 mm, $D_7$=2.7 mm, t1=3.3 mm, t2=2.1 mm, t3==1.2 mm, tA=1.7 mm.

Figure 3:
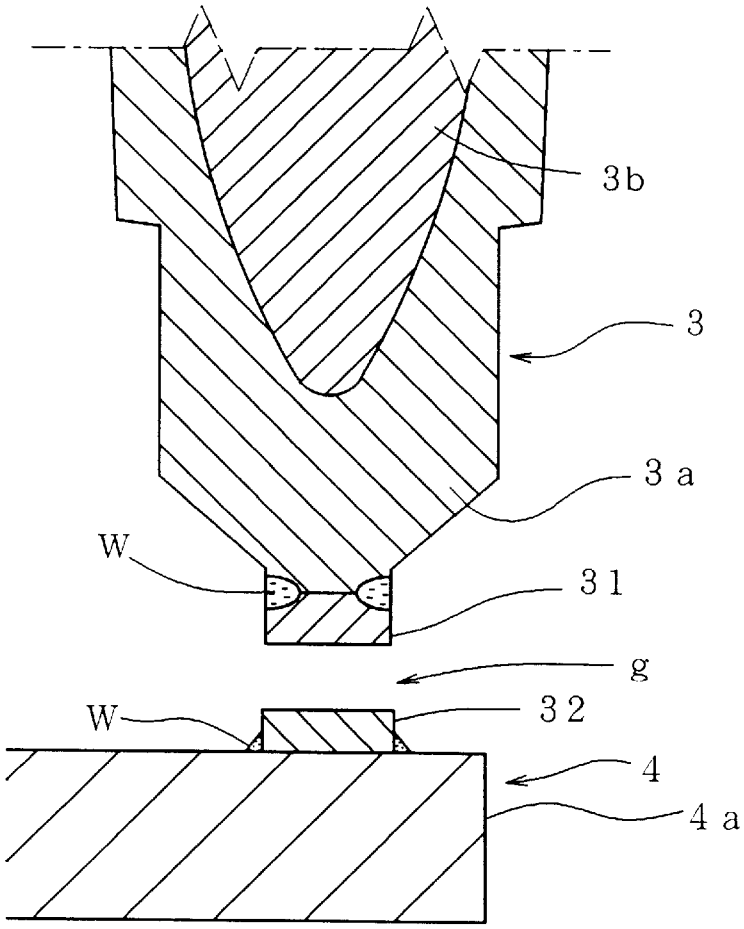
FIG. 3 is a cross-sectional view showing a proximity to the ignition part of FIG. 2.

Referring next to FIGS. 2 and 3, body portions 3*a* and 4*a* of the center electrode 3 and the ground electrode 4 are made of Ni alloy or the like. Inside the body portion 3*a* of the center electrode 3, is buried a core material 3*b* made of Cu or Cu alloy or the like for the promotion of heat radiation. Meanwhile, the ignition portion 31 and the ignition portion 32 opposite thereto are made mainly from noble metal alloy. As shown in FIG. 3, the body portion 3*a* of the center electrode 3 is reduced in diameter on the tip end side with the tip end surface made flat. On this portion, a disc-shaped chip formed of an alloy composition and serving as the igniter is overlaid, in which state a weld W is formed by laser welding, electron beam welding, resistance welding or the like along the outer edge portion of their joint portion, and then fixed, so that the ignition portion 31 is formed. Also, the opposite ignition portion 32 is formed through steps of aligning a chip with the ground electrode 4 in a position corresponding to the ignition portion 31, forming a weld W likewise along the outer edge portion of their joint portion, and fixing the resulting weld. In addition, these chips may be either an ingot material obtained by blending and melting alloy components into a specified composition or a sintered material obtained by compacting and sintering an alloy powder or a powder of metal simple substances blended at a specified ratio. It is noted that at least one of the ignition portion 31 and its opposite ignition portion 32 may be omitted.

The above spark plug 100 is manufactured by the following process as an example. First, the insulator 2 is produced by sintering a powder compact of a specified material powder. Then, a specified surface area of the insulator 2 is coated with a glaze slurry, by which a glaze slurry coated layer 2*d'* (FIG. 6) is formed, and then the layer is dried.

Figures 6A, 6B, 6C, 6D:
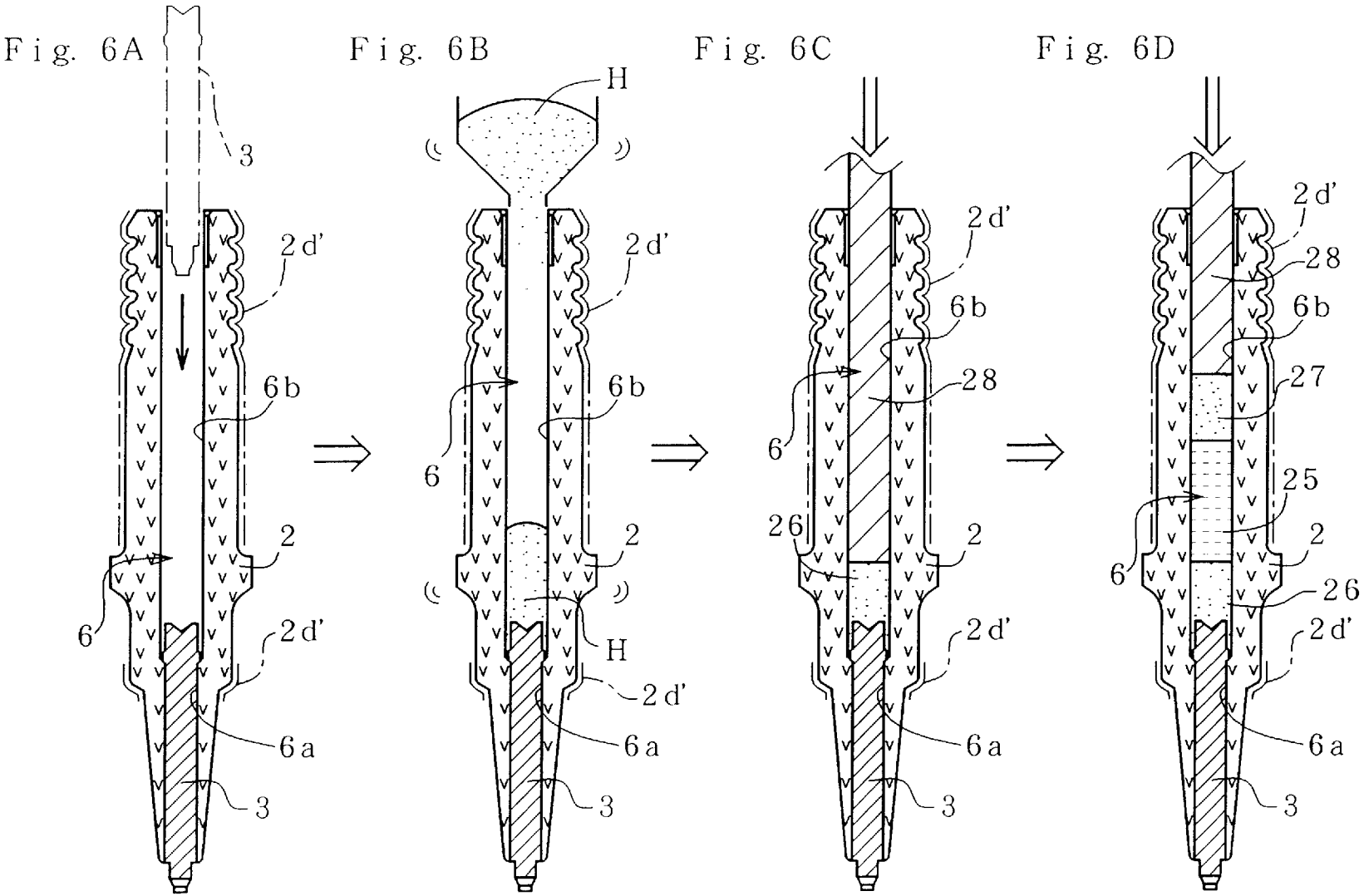
FIGS. 6A–6D are explanatory views for explaining the glass seal step.

Next, the assembly process of the center electrode 3 and the terminal 13 to the glaze slurry coated layer 2*d'* as well as the formation process of the resistor 15 and the conductive glass seal layers 16, 17 are outlined below. First, as shown in FIG. 6A, with respect to the through hole 6 of the insulator 2, the center electrode 3 is inserted into its first portion 6*a* and then, as shown in FIG. 6B, conductive glass powder H is filled thereinto. Then, as shown in FIG. 6C, a presser bar 28 is inserted into the through hole 6, the filled powder H is preliminarily compressed, by which a first conductive glass powder layer 26 is formed. Subsequently, material powder of the resistor composition is filled thereinto, preliminarily compressed similarly, and with conductive glass powder further filled, the resulting product is preliminarily compressed. As a result, as shown in FIG. 6D, in the through hole 6, the first conductive glass powder layer 26, a resistor-composition powder layer 25 and a second conductive glass powder layer 27 are stacked one on another, as viewed from the center electrode 3 side (from below).

Figure 7A:
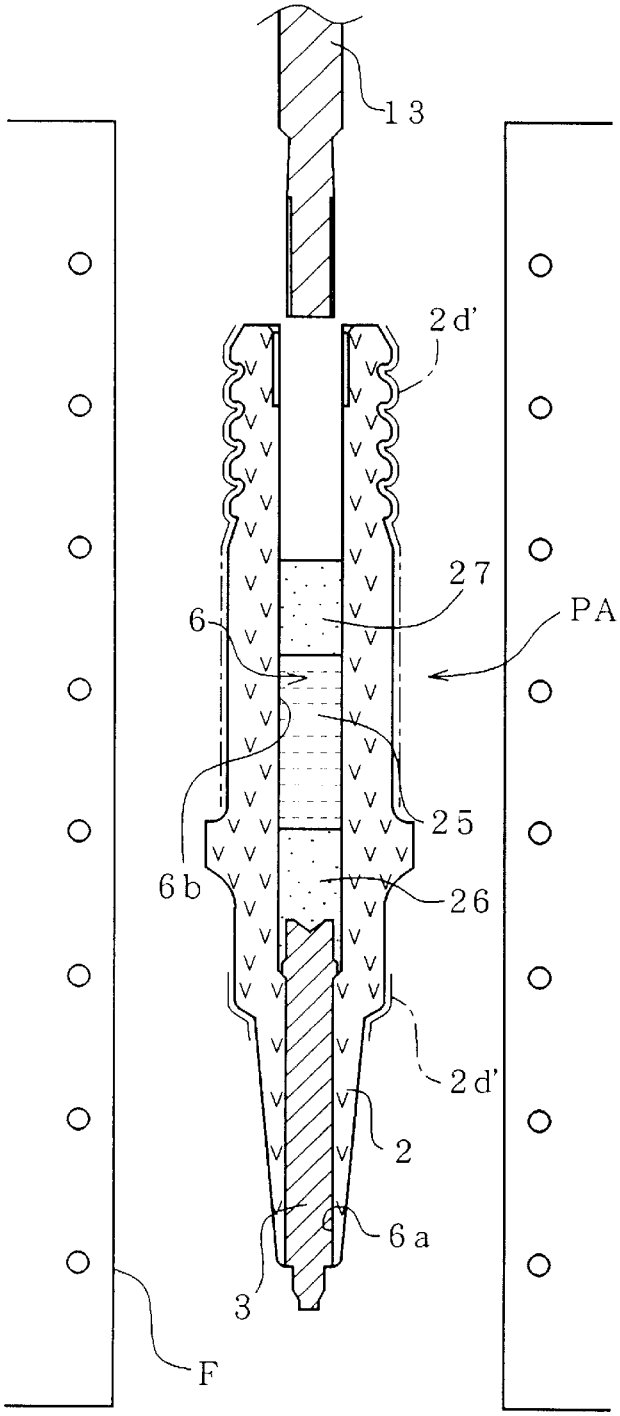
FIGS. 7A and 7B are explanatory views subsequent to FIGS. 6A–6D and FIG. 8 is an explanatory view for defining the size of various particles in the resistor.
Figure 7B:
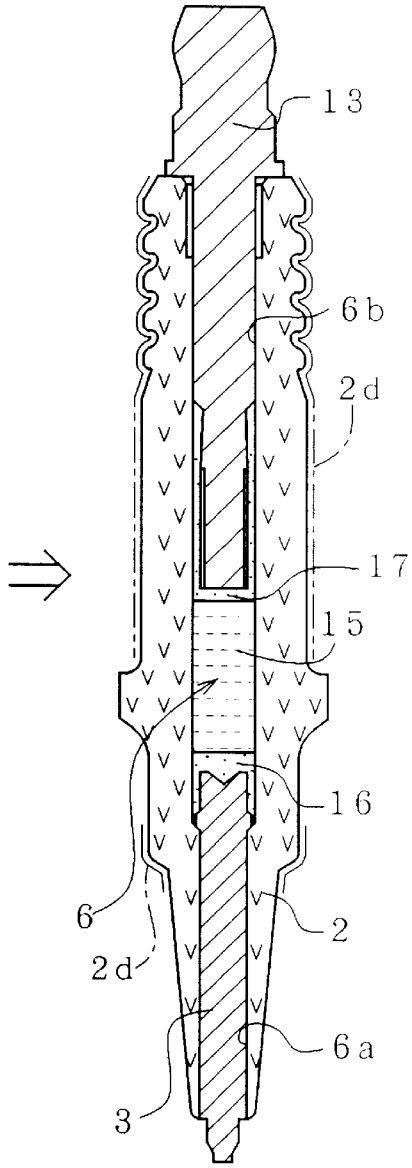
Figure 8:
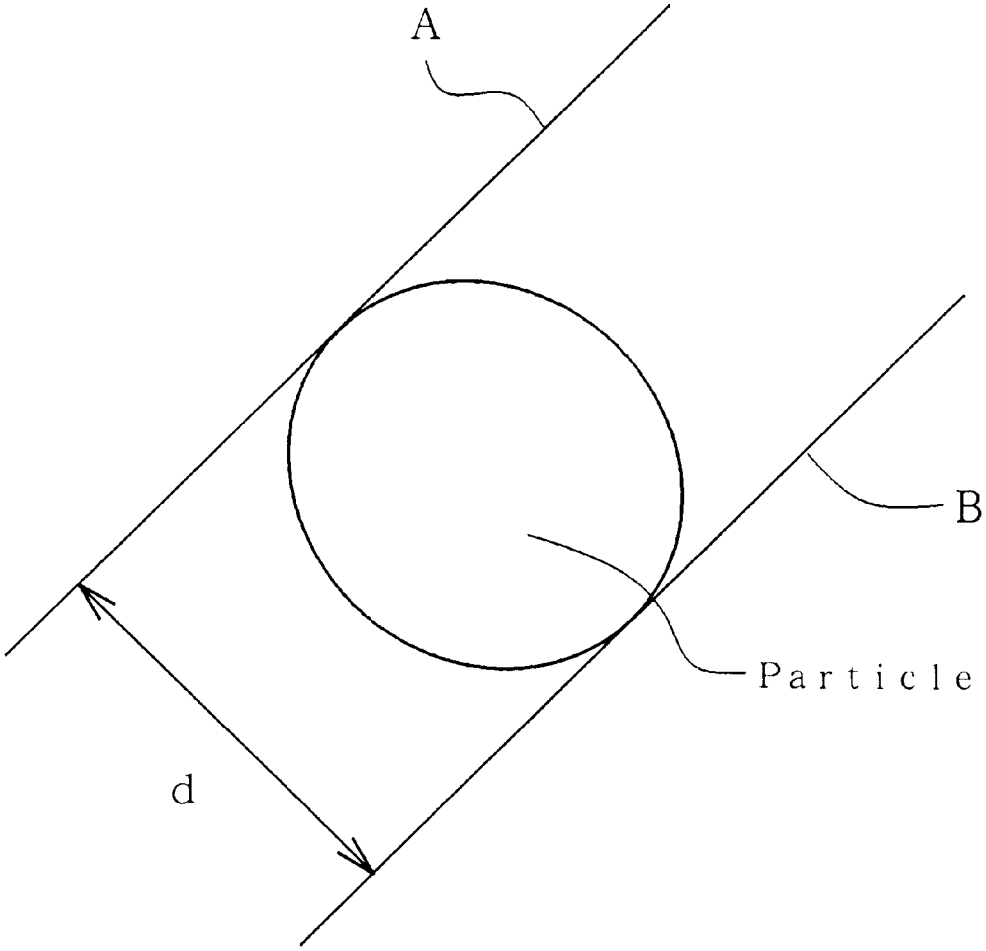

Subsequently, as shown in FIG. 7A, an assembly PA in which the terminal 13 is disposed into the through hole 6 from above is formed. Then, the assembly PA is inserted into a kiln as it is, where it is heated to a specified temperature of 800–950° C., which is higher than the glass softening point. Afterwards, the terminal 13 is pressed into the through hole 6 axially from a side opposite to the center electrode 3 so that the layers 25 to 27 in the stacked state are pressed axially. As a result, as shown in FIG. 7B, the individual layers are compressed and baked, forming the conductive glass seal layer 16, the resistor 15 and the conductive glass seal layer 17, respectively (this is an end of the glass seal step).

To the assembly PA with which the glass seal step has been completed in this way, the metallic shell 1, the ground electrode 4 and the like are assembled, by which the spark plug 100 shown in FIG. 1 is completed. The spark plug 100 is mounted at its threaded portion 7 to an engine block via a gasket 101, and put into use as an ignition source for fuel-air mixture fed to the combustion chamber.

EXAMPLES

Effects of the present invention are described in more detail below by the following examples.

(Example 1)

A fine-particle glass powder (mean particle size 80 μm), a $TiO_2$ powder, various kinds of ceramic powders other than $TiO_2$ (mean particle size 1–4 μm), various kinds of metal powders for formation of metallic phase (mean particle size 20–50 μm), carbon black as a non-metallic conductive material powder, and dextrin as an organic binder were blended in specified amounts and wet mixed with water as a solvent by a ball mill, and thereafter dried, by which a preparatory material was prepared. Then, a coarse-particle glass powder (mean particle size 250 μm) was blended in a specified amount, by which a basis material was prepared. This basis material was molded by hot press with a temperature of 900° C. and a pressure of 100 MPa, so that resistor compositions were obtained.

The material of the glass powder was borosilicate lithium glass obtained by blending and melting 50 wt % of $SiO_2$, 29 wt % of $B_2O_3$, 4 wt % of $Li_2O$ and 17 wt % of BaO, and its softening temperature was 585° C. Also, for the above $TiO_2$, two type of $TiO_2$'s were used in combination, one having a mean particle size of 0.4 μm and a particle size distribution with a 3σ range of 0.05–0.5 μm around the mean particle size, where the standard deviation of particle size was σ (hereinafter, referred to as A type), and the other having a mean particle size of 4 μm and a particle size distribution with a 3σ range of 2–8 μm around the mean particle size (hereinafter, referred to as B type), the two of which were used at an appropriate ratio in mixture. In addition, it was found by X-ray diffraction that the former A type of $TiO_2$ was anatase type to 90 wt % or more to the entirety, and the latter B type of $TiO_2$ was rutile type to 90 wt % or more to the entirety.

With regard to the resistor compositions obtained, the content ratios of the rutile type $TiO_2$ and the anatase type $TiO_2$ to the entire $TiO_2$ were determined by X-ray diffraction. Results are shown in Tables 1, 3 and 5. Also, in each of the tables, contents of the coarse-particle glass, the fine-particle glass, the $TiO_2$ and the ceramic and metallic phases other than $TiO_2$ are shown by values estimated from the blending ratio in the preparation of the resistor composition. The content of carbon in the resistor composition was determined by gas analysis. Further, the mean particle size of A type and B type mixed $TiO_2$ powder was measured by using a laser diffraction type particle size analyzer.

Out of the resistor composition, a 3 mm high, 3 mm wide and 10 mm long sample was cut out and the value of specific electrical resistivity of the bulks was measured by Wheatstone bridge method. Also, the resistor composition was cut into a specified configuration to make a sample for evaluation of vitrification and its cross section was observed by an optical microscope (magnifying power 20). In this evaluation, samples in which considerable amounts of pores could be observed and which instantaneously absorb water upon a drip of a little water were evaluated as vitrification fault (X), and samples in which pores could hardly be observed and which did not absorb water were evaluated as vitrification good (O). Results are shown in Tables 2, 4 and 6 (the results of Tables 2, 4 and 6 are in correspondence to the compositions of the resistor compositions of Table 1, 3 and 5, respectively).

Next, the resistor 15 of the spark plug 100 shown in FIG. 1 was fabricated by the process shown in FIGS. 6 and 7 with the individual resistor compositions. Dimensions of the individual parts of the insulator 2 shown in FIG. 5 as an aid are as follows: L1=approx. 60 mm, L2=approx. 10 mm, L3=approx. 18 mm, D1=10 mm, D2=approx. 12 mm, D3=approx. 9 mm, D4=7 mm, D5=5 mm, D6=4 mm, D7=2.5 mm, t1=2.5 mm, t2=2.0 mm, t3=1.2 mm, tA=2.25 mm. As the conductive glass powder, one in which the Cu powder and a calcium borosilicate glass (softening temperature 780° C.) powder were blended at a weight ratio of 1:1 was used. In addition, 0.2 g of this conductive glass powder was used to form the conductive glass seal layer 16, 0.5 g of the aforementioned basis material was used to form the resistor 15, and 0.3 g of the conductive glass powder was used to form the conductive glass seal layer 17.

With regard to these spark plugs 100, the load life characteristic was measured by the following process. That is, the spark plug was attached to an automobile transistor igniter, and subjected to a 100 hour electric discharge under the conditions of a discharge voltage of 20 kV and a number of times of discharge of 3600 per minute, where the resulting change in resistance value was measured. As evaluation criteria, spark plugs which yielded positive changes in resistance value of 2 kΩ or more were evaluated as no good (X), and those which did not were evaluated as good With regard to the radio frequency noise performance, interfering field strength was measured with test frequencies of 5–1000 MHz by the measuring method prescribed by CISPR (International Special Committee on Radio Interference). Then, spark plugs which showed field strengths less than the critical value prescribed in the CISPR standards (hereinafter, referred to as CISPR critical value) by 3 dB or more were evaluated as excellent (_), those which showed field strengths equal to or less than the CISPR critical value were evaluated as good (O), and those which showed field strengths exceeding the CISPR critical value were evaluated as no good (X). Also, with respect to temperature characteristic, assuming that the resistance value between the terminal 13 and the center electrode 3 at 20° C. was α1 and likewise the resistance value at 150° C. (held for two hours) was α2, and depending on the value of $\gamma=(\alpha2-\alpha1)/\alpha1$, spark plugs showing γ values within a range of −0.25 to 0 were evaluated as excellent (_), those showing γ values within a range of −0.30 to −0.25 as good (O) and those showing γ values less than −0.30 as no good (X). These results are shown in Tables 2, 4 and 6.

Table 1:

Table 2:

Table 3:

Table 4:

Table 5:

Table 6:

First, as shown in Tables 1 and 2, spark plugs having a generally constant content ratio of the rutile type $TiO_2$ to the anatase type $TiO_2$ in the resistor composition were found that those whose total content of $TiO_2$ fell within a range of 0.5 to 20 wt % were good at both load life characteristic and temperature characteristic. Also, the value of γ was also not less than −0.30.

Figure 4:
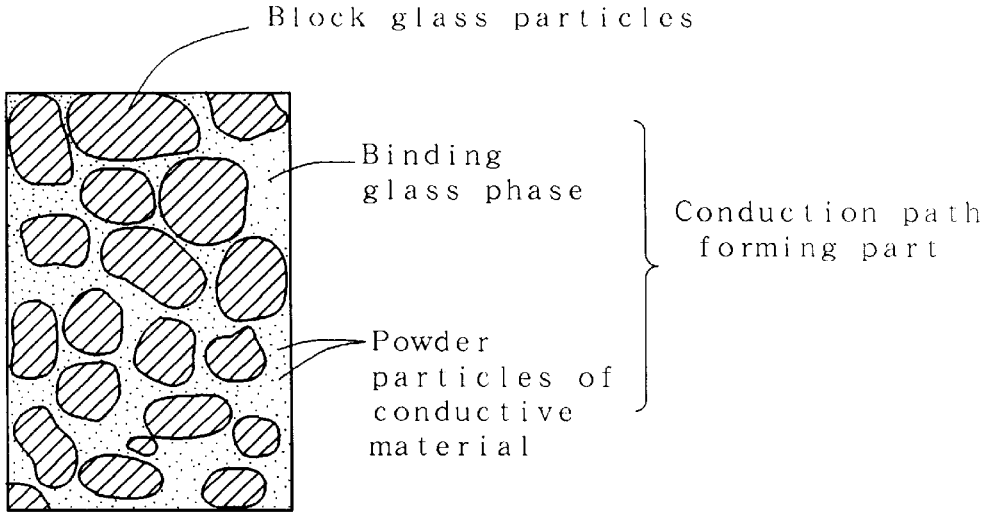
FIG. 4 is a schematic view showing the structure of the resistor.

Next, as shown in FIGS. 3 and 4, it can be understood that spark plugs whose mean particle size of $TiO_2$ in the resistor composition is 0.5 to 20 μm are good at both radio frequency noise characteristic and load life characteristic. It can also be understood that spark plugs whose content ratio of the rutile phase in the total amount of $TiO_2$ was not less than 20 wt % obtained good temperature characteristics. Further, it can be understood that spark plugs whose content of carbon in the resistor composition was in a range of 0.5 to 5 wt % were good at both radio frequency noise characteristic and load life characteristic.

(Example 2)

A fine-particle glass powder (mean particle size 80 μm), various kinds of powders of $MgTiO_3$, $MgZrO_3$, $CaTiO_3$, $SrTiO_3$, $BaTiO_3$ and $BaZrO_3$ as specific complex oxides (mean particle size 0.1–25 μm) , $ZrO_2$ as a ceramic powder other than the specific complex oxides (mean particle size 1–4 μm), various kinds of metal powders for formation of metallic phase (mean particle size 20–50 μm), carbon black as a non-metallic conductive material powder, and dextrin as an organic binder were blended in specified amounts and wet mixed with water used as a solvent by a ball mill, and thereafter dried, by which a preparatory material was prepared. In addition, for comparison's sake, a preparatory material using $TiO_2$ (anatase type) instead of the specific complex oxides was also fabricated.

Then, a coarse-particle glass powder (mean particle size 250 μm) was blended in a specified amount, by which a basis material was prepared. This basis material was molded by hot press with a temperature of 900° C. and a pressure of 100 MPa, so that resistor compositions were obtained. In addition, the material of the glass powder was the same as in Example 1. With regard to the resistor compositions obtained, the content of carbon was determined by gas analysis. Results are shown in Table 7. Also, in Table 7, contents of the coarse-particle glass, the fine-particle glass, the specific complex oxides and the ceramics other than the specific complex oxides are shown by values estimated from the blending ratio in the preparation of the resistor compositions.

Then, the value of specific electrical resistivity of the bulks of the resistor compositions was measured in the same way as in Example 1. Also, various types of spark plugs similar to those of Example 1 except the composition of the resistor 15 were prepared and a similar experiment was carried out. Results are shown in Table 8.

Table 7:

Table 8:

Consequently, spark plugs whose total content of the specific complex oxides of the resistor was within a range of 0.5 to 20 wt % were found that both load life characteristic and temperature characteristic are good, as compared with those using $TiO_2$ instead of the specific complex oxides, and that the value of $\gamma$ is also not less than −0.30. Further, it can be understood that spark plugs whose mean particle size of the specific complex oxides in the resistor composition is 0.5 to 20 $\mu$m are good at both radio frequency noise characteristic and load life characteristic.

(Example 3)

A fine-particle glass powder (mean particle size 80 $\mu$m), a metal Ti powder or $Ti_3O_5$ powder (mean particle size 0.5–200 $\mu$m), $ZrO_2$ as a ceramic powder (mean particle size 1–4 $\mu$m), carbon black as a non-metallic conductive material powder, and PVA as an organic binder were blended in specified amounts and wet mixed with water as a solvent by a ball mill, and thereafter dried, by which a preparatory material was prepared. In addition, for comparison's sake, a preparatory material using $TiO_2$ (anatase type) instead of the specific complex oxides was also fabricated.

Then, a coarse-particle glass powder (mean particle size 250 $\mu$m) was blended in a specified amount, by which a basis material was prepared. This basis material was molded by hot press with a temperature of 900° C. and a pressure of 100 MPa, so that resistor compositions were obtained. In addition, the material of the glass powder was the same as in Example 1. With regard to the resistor compositions obtained, the content of carbon was determined by gas analysis. Results are shown in Table 10. Also, in Table 9, contents of the coarse-particle glass, the fine-particle glass, the metal Ti or $Ti_3O_5$and the $ZrO_2$ are shown by values estimated from the blending ratio in the preparation of the resistor compositions.

Then, the value of specific electrical resistivity of the bulks of the resistor compositions was measured in the same way as in Example 1. Also, various types of spark plugs similar to those of Example 1 except the composition of the resistor 15 were prepared and a similar experiment was carried out. Results of the above are shown in Table 10.

Table 9:

Table 10:

Consequently, spark plugs in which the metal Ti or $Ti_3O_5$ was blended in the resistor were found that both load life characteristic and temperature characteristic are good, as compared with those using $TiO_2$ instead of the metal Ti or $Ti_3O_5$ . In this case, it can be understood that when the content of the metal Ti or $Ti_3O_5$ is 0.5 to 10 wt % (desirably 3–5 wt %), or when its particle size is 5 to 100 $\mu$m (desirably 20–50 $\mu$m), even better results are obtained.

(Example 4)

A fine-particle glass powder (mean particle size 80 $\mu$m), a TiC or TiN powder (mean particle size 0.7–5 $\mu$m, amount of oxygen contained was previously identified by gas analysis), $ZrO_2$ as a ceramic powder (mean particle size 1–4 $\mu$m), and PVA as an organic binder were blended in specified amounts and wet mixed with water used as a solvent by a ball mill, and thereafter dried, by which a preparatory material was prepared. In addition, for comparison's sake, a material using carbon black (mean particle size 0.06 $\mu$m) instead of the TiC or TiN powder was also prepared.

Then, a coarse-particle glass powder (mean particle size 250 $\mu$m) was blended in a specified amount, by which a basis material was prepared. This basis material was molded by hot press with a temperature of 900° C. and a pressure of 100 MPa, so that resistor compositions were obtained. In addition, the material of the glass powder was borosilicate lithium—barium glass obtained by blending and melting 60 parts by weight of $SiO_2$, 25 parts by weight of $B_2O_3$, 5 parts by weight of $Li_2O$ and 7 parts by weight of BaO, and its softening temperature was 720° C. With regard to the resistor compositions obtained, the content of carbon was determined by gas analysis. Results are shown in Tables 11 and 13. Also, in Tables 11 and 13, contents of the coarse-particle glass, the fine-particle glass, the TiC or TiN, and the $ZrO_2$ are shown by values estimated from the blending ratio in the preparation of the resistor compositions. In addition, by subtracting the quantity WC1 of carbon component contained in the TiC from the total analysis quantity WC0 of carbon component (which is estimated from the blending amount of TiC in this example but may also be calculated by determining the content of Ti as a result of directly analyzing the resistor with ICP analysis or the like and by determining a value of carbon component equimolar to the resulting content of Ti), the quantity WCP (=WC0−WC1) of free carbon component was calculated.

Then, the value of specific electrical resistivity of the bulks of the resistor compositions was measured in the same way as in Example 1. Also, various types of spark plugs similar to those of Example 1 except the composition of the resistor 15 were prepared and the following experiment was carried out. For the load life characteristic, first an initial resistance R0 of the spark plug was measured. Then, the spark plug was attached to an automobile transistor igniter, increased in temperature to 350° C. and subjected to a 30 hour electric discharge under the conditions of a discharge voltage of 20 kV and a number of times of discharge of 3600 per minute, where the resulting resistance value was R and the spark plugs were evaluated by a resulting rate of change of resistance$\Delta R=\{(R-R0)/R\}\times 100$ (%). Further, the radio frequency noise characteristic was evaluated in the same way as in Example 1. Results of the above are shown in Tables 12 and 14.

Table 11:

Table 12:

Table 13:

Table 14:

Consequently, spark plugs in which the TiC or TiN was used instead of part of the carbon black as a conductive material were found that the load life characteristic is good even at high temperature (350° C.). In this case, when the content of the TiC or TiN was 1 to 10 wt % (desirably 5 to 6 wt %), the initial resistance value was also relatively low and a particularly satisfactory result was obtained also in the radio frequency noise performance. Further, it can also be seen that when the particle size of the TiC or TiN is not more than 5 μm or when the oxygen content of the material TiC or TiN powder is set to less than 3 wt %, the load life characteristic can be made even more satisfactory.

(Example 5)

A fine-particle glass powder (mean particle size 80 μm), carbon blacks having various particle sizes and structure lengths, $ZrO_2$ as a ceramic powder (mean particle size 1–4 μm), and polyethylene glycol as an organic binder were blended in specified amounts and wet mixed with water used as a solvent by a ball mill, and thereafter dried, by which a preparatory material was prepared. In addition, the mean particle size of the carbon blacks was measured by using a laser diffraction type particle size meter, and the structure length was measured by a process described in JIS as mentioned before.

Then, a coarse-particle glass powder (mean particle size 250 μm) was blended in a specified amount, by which a basis material was prepared. This basis material was molded by hot press with a temperature of 900° C. and a pressure of 100 MPa, so that resistor compositions were obtained (sample numbers 1–24). In addition, the material of the glass powder was the same as in Example 1. With regard to the resistor compositions obtained, values of apparent density measured by the Archimedes' method are shown in Table 15. Also, in Tables 15, contents of the coarse-particle glass, the fine-particle glass, and the $ZrO_2$ are shown by values estimated from the blending ratio in the preparation of the resistor compositions. Next, various types of spark plugs similar to those of Example 1 except the composition of the resistor 15 were prepared (n=20 for each sample number). In addition, the initial value of electrical resistance of each spark plug (a value between the center electrode 3 and the terminal 13 via the resistor 15) was adjusted by the blending amount of carbon black so as to be 5 kΩ±0.3 kΩ. With these spark plugs, the following experiment was carried out.

First, the electrical resistance (a value between the center electrode 3 and the terminal 13 via the resistor 15) of each spark plug was measured by the Wheatstone bridge process, where standard deviation was calculated for each sample number. Then, spark plugs with $3\sigma<0.6$ were evaluated as __ (excellent), those with $0.6\leqq 3\sigma<1.2$ as O (good), those with $1.2\leqq 3\sigma<1.8$ as _ (acceptable), and those with $3\sigma\geqq 1.8$ as X (unacceptable). Also, for the load life characteristic, first an initial resistivity R0 of the spark plug was measured. Then, the spark plug was attached to an automobile transistor igniter and subjected to a 250 hour electric discharge under the conditions of a discharge voltage of 20 kV and a number of times of discharge of 3600 per minute, where the resulting resistance value was R and the spark plugs were evaluated by a resulting rate of change of resistance $\Delta R=\{(R-R0)/R\}\times 100$ (%). As the evaluation criteria, spark plugs with ΔR within ±15% were evaluated as __ (excellent), those with ΔR within ±25% as O (good), those with ΔR within ±30% as _ (acceptable) and those with ΔR more beyond ±30% as X (unacceptable). Results of the above are shown in Table 15.

Table 15:

From these experiment results, the following can be proved.

That is, when a carbon black having a mean particle size of 20 nm–80 nm and a structure length of 60 ml–120 ml/100 g is used, the blending amount of carbon black can be reduced in obtaining a prescribed electrical resistance (5±0.3 kΩ in this case), so that the apparent density of the resistor is increased. Besides, the resulting resistance had less variations and a satisfactory load life characteristic was also obtained.

TABLE 1

| Sample No. | Content of coarse-particle glass (wt %) | Content of fine-particle glass (wt %) | Content ratio of rutile type $TiO_2$ (wt %) | Content ratio of anatase type $TiO_2$ (wt %) | Total content of $TiO_2$ (wt %) | Mean particle size of $TiO_2$ (μm) | Ceramics other than $TiO_2$ (wt %) | Metallic phase (wt %) | Carbon (wt %) | Blending amount of carbon black (wt %) |
|---|---|---|---|---|---|---|---|---|---|---|
| 1 | 80 | 5.0 | — | — | 0 | — | 13.1 | 0.1 | 1.8 | 0.6 |
| 2 | 90 | 4.7 | 60 | 40 | 0.5 | 2.5 | 2.9 | 0.1 | 1.8 | 1.2 |
| 3 | 84 | 5.1 | 60 | 40 | 1.0 | 2.5 | 8.0 | 0.1 | 1.8 | 0.6 |
| 4 | 85 | 5.0 | 60 | 40 | 2.0 | 2.5 | 6.2 | 0.1 | 1.8 | 0.45 |
| 5 | 75 | 13.2 | 60 | 40 | 3.0 | 2.5 | 6.9 | 0.1 | 1.8 | 0.9 |
| 6 | 70 | 7.9 | 60 | 40 | 5.0 | 2.5 | 10.2 | 0.1 | 1.8 | 0.6 |
| 7 | 60 | 6.0 | 60 | 40 | 7.0 | 2.5 | 18.1 | 0.1 | 1.8 | 0.8 |
| 8 | 62 | 8.4 | 60 | 40 | 10.0 | 2.5 | 17.7 | 0.1 | 1.8 | 0.6 |
| 9 | 65 | 12.5 | 60 | 40 | 15.0 | 2.5 | 5.6 | 0.1 | 1.8 | 0.9 |
| 10 | 70 | 4.9 | 60 | 40 | 20.0 | 2.5 | 3.2 | 0.1 | 1.8 | 0.6 |
| 11 | 65 | 3.5 | 60 | 40 | 25.0 | 2.5 | 4.8 | 0.1 | 1.8 | 0.6 |

TABLE 2

| Sample No. | Vitrification | Load life characteristic | Radio frequency noise characteristic | Temperature characteristic | Specific electrical resistivity (Ω · cm) $\alpha_1$ 20° C. | $\alpha_2$ 150° C. | $\gamma=(\alpha_2-\alpha_1)/\alpha_1$ |
|---|---|---|---|---|---|---|---|
| 1 | ○ | X | ◎ | ◎ | 430 | 330 | −0.233 |
| 2 | ○ | ○ | ◎ | ◎ | 1250 | 975 | −0.223 |
| 3 | ○ | ○ | ◎ | ◎ | 780 | 590 | −0.244 |
| 4 | ○ | ○ | ◎ | ○ | 830 | 610 | −0.265 |

TABLE 2-continued

| Sample No. | Vitrification | Load life characteristic | Radio frequency noise characteristic | Temperature characteristic | Specific electrical resistivity (Ω · cm) $\alpha_1$ 20° C. | $\alpha_2$ 150° C. | $\gamma = (\alpha_2 - \alpha_1)/\alpha_1$ |
|---|---|---|---|---|---|---|---|
| 5 | ○ | ○ | ◎ | ○ | 620 | 450 | −0.274 |
| 6 | ○ | ○ | ◎ | ○ | 580 | 423 | −0.271 |
| 7 | ○ | ○ | ○ | ○ | 400 | 300 | −0.250 |
| 8 | ○ | ○ | ○ | ○ | 360 | 260 | −0.278 |
| 9 | ○ | ○ | ○ | ○ | 440 | 330 | −0.250 |
| 10 | ○ | ○ | ○ | ○ | 300 | 210 | −0.300 |
| 11 | ○ | ○ | ○ | X | 460 | 280 | −0.391 |

TABLE 3

| Sample No. | Content of coarse-particle glass (wt %) | Content of fine-particle glass (wt %) | Content ratio of rutile type $TiO_2$ (wt %) | Content ratio of anatase type $TiO_2$ (wt %) | Total content of $TiO_2$ (wt %) | Mean particle size of $TiO_2$ (μm) | Ceramics other than $TiO_2$ (wt %) | Metallic phase (wt %) | Carbon (wt %) | Blending amount of carbon black (wt %) |
|---|---|---|---|---|---|---|---|---|---|---|
| 21 | 75 | 6.5 | 0 | 100 | 10 | 0.4 | 6.9 | 0.1 | 1.5 | 0.45 |
| 22 | 75 | 6.5 | 10 | 90 | 10 | 0.8 | 6.9 | 0.1 | 1.5 | 0.5 |
| 23 | 75 | 6.5 | 20 | 80 | 10 | 1.2 | 6.9 | 0.1 | 1.5 | 0.8 |
| 24 | 75 | 6.5 | 30 | 70 | 10 | 1.5 | 6.9 | 0.1 | 1.5 | 0.85 |
| 25 | 75 | 6.5 | 40 | 60 | 10 | 1.8 | 6.9 | 0.1 | 1.5 | 0.9 |
| 26 | 75 | 6.5 | 50 | 50 | 10 | 2.3 | 6.9 | 0.1 | 1.5 | 0.6 |
| 27 | 75 | 6.5 | 60 | 40 | 10 | 2.5 | 6.9 | 0.1 | 1.5 | 0.6 |
| 28 | 75 | 6.5 | 70 | 30 | 10 | 3.2 | 6.9 | 0.1 | 1.5 | 0.5 |
| 29 | 75 | 6.5 | 80 | 20 | 10 | 3.4 | 6.9 | 0.1 | 1.5 | 0.6 |
| 30 | 75 | 6.5 | 90 | 10 | 10 | 3.8 | 6.9 | 0.1 | 1.5 | 1.1 |
| 31 | 55 | 6.5 | 100 | 0 | 10 | 4.0 | 6.9 | 0.1 | 1.5 | 1.2 |
| 32 | 75 | 6.5 | 50 | 80 | 10 | 5.0 | 6.9 | 0.1 | 1.5 | 1.3 |
| 33 | 75 | 6.5 | 50 | 80 | 10 | 7.0 | 6.9 | 0.1 | 1.5 | 1.5 |
| 34 | 75 | 6.5 | 50 | 80 | 10 | 10.0 | 6.9 | 0.1 | 1.5 | 2.0 |
| 35 | 75 | 6.5 | 50 | 80 | 10 | 20.0 | 6.9 | 0.1 | 1.5 | 2.8 |

TABLE 4

| Sample No. | Vitrification | Load life characteristic | Radio frequency noise characteristic | Temperature characteristic | Specific electrical resistivity (Ω · cm) $\alpha_1$ 20° C. | $\alpha_2$ 150° C. | $\gamma = (\alpha_2 - \alpha_1)/\alpha_1$ |
|---|---|---|---|---|---|---|---|
| 21 | ○ | ○ | X | X | 520 | 350 | −0.327 |
| 22 | ○ | ○ | ○ | ○ | 750 | 530 | −0.293 |
| 23 | ○ | ○ | ○ | ○ | 630 | 450 | −0.286 |
| 24 | ○ | ○ | ○ | ○ | 550 | 400 | −0.273 |
| 25 | ○ | ○ | ◎ | ◎ | 460 | 350 | −0.239 |
| 26 | ○ | ○ | ◎ | ◎ | 520 | 400 | −0.231 |
| 27 | ○ | ○ | ◎ | ◎ | 480 | 370 | −0.229 |
| 28 | ○ | ○ | ◎ | ◎ | 630 | 490 | −0.222 |
| 29 | ○ | ○ | ◎ | ◎ | 520 | 410 | −0.212 |
| 30 | ○ | ○ | ◎ | ◎ | 480 | 380 | −0.208 |
| 31 | ○ | ○ | ◎ | ◎ | 400 | 320 | −0.200 |
| 32 | ○ | ○ | ◎ | ◎ | 530 | 408 | −0.230 |
| 33 | ○ | ○ | ◎ | ◎ | 481 | 369 | −0.233 |
| 34 | ○ | ○ | ◎ | ◎ | 477 | 365 | −0.235 |
| 35 | ○ | ○ | ◎ | ◎ | 521 | 402 | −0.228 |

TABLE 5

| Sample No. | Content of coarse-particle glass (wt %) | Content of fine-particle glass (wt %) | Content ratio of rutile type $TiO_2$ (wt %) | Content ratio of anatase type $TiO_2$ (wt %) | Total content of $TiO_2$ (wt %) | Mean particle size of $TiO_2$ (μm) | Ceramics other than $TiO_2$ (wt %) | Metallic phase (wt %) | Carbon (wt %) | Blending amount of carbon black (wt %) |
|---|---|---|---|---|---|---|---|---|---|---|
| 41 | 72 | 6.5 | 60 | 40 | 10 | 2.5 | 11.1 | 0.2 | 0.2 | 0.1 |
| 42 | 72 | 6.5 | 60 | 40 | 10 | 2.5 | 10.9 | 0.2 | 0.4 | 0.2 |
| 43 | 72 | 6.5 | 60 | 40 | 10 | 2.5 | 10.7 | 0.2 | 0.6 | 0.2 |
| 44 | 72 | 6.5 | 60 | 40 | 10 | 2.5 | 10.1 | 0.2 | 1.2 | 0.45 |

TABLE 5-continued

| Sample No. | Content of coarse-particle glass (wt %) | Content of fine-particle glass (wt %) | Content ratio of rutile type $TiO_2$ (wt %) | Content ratio of anatase type $TiO_2$ (wt %) | Total content of $TiO_2$ (wt %) | Mean particle size of $TiO_2$ (μm) | Ceramics other than $TiO_2$ (wt %) | Metallic phase (wt %) | Carbon (wt %) | Blending amount of carbon black (wt %) |
|---|---|---|---|---|---|---|---|---|---|---|
| 45 | 72 | 6.5 | 60 | 40 | 10 | 2.5 | 9.8 | 0.2 | 1.5 | 0.6 |
| 46 | 72 | 6.5 | 60 | 40 | 10 | 2.5 | 9.5 | 0.2 | 1.8 | 0.3 |
| 47 | 72 | 6.5 | 60 | 40 | 10 | 2.5 | 8.8 | 0.2 | 2.5 | 2.1 |
| 48 | 72 | 6.5 | 60 | 40 | 10 | 2.5 | 8.4 | 0.2 | 2.9 | 1.6 |
| 49 | 72 | 6.5 | 60 | 40 | 10 | 2.5 | 7.7 | 0.2 | 3.6 | 1.8 |
| 50 | 72 | 6.5 | 60 | 40 | 10 | 2.5 | 6.3 | 0.2 | 5.0 | 4.5 |
| 51 | 72 | 6.5 | 60 | 40 | 10 | 2.5 | 4.5 | 0.2 | 6.8 | 4.0 |

TABLE 6

| Sample No. | Vitrification | Load life characteristic | Radio frequency noise characteristic | Temperature characteristic | Specific electrical resistivity (Ω · cm) $\alpha_1$ 20° C. | $\alpha_2$ 150° C. | $\gamma = (\alpha_2 - \alpha_1)/\alpha_1$ |
|---|---|---|---|---|---|---|---|
| 41 | ○ | X | ◎ | ○ | 2050 | 1480 | −0.278 |
| 42 | ○ | X | ◎ | ○ | 1500 | 1110 | −0.260 |
| 43 | ○ | ○ | ◎ | ○ | 1200 | 850 | −0.292 |
| 44 | ○ | ○ | ◎ | ○ | 650 | 470 | −0.277 |
| 45 | ○ | ○ | ◎ | ○ | 500 | 380 | −0.240 |
| 46 | ○ | ○ | ◎ | ○ | 320 | 240 | −0.250 |
| 47 | ○ | ○ | ◎ | ○ | 100 | 73 | −0.270 |
| 48 | ○ | ○ | ○ | ○ | 120 | 89 | −0.258 |
| 49 | ○ | ○ | ○ | ◎ | 90 | 69 | −0.233 |
| 50 | ○ | ○ | ○ | ◎ | 85 | 68 | −0.200 |
| 51 | ○ | ○ | X | ◎ | 48 | 40 | −0.167 |

TABLE 7

| Sample No. | Content of coarse-particle glass (wt %) | Content of fine-particle glass (wt %) | Material of specific complex oxide | Mean particle size of the same (μm) | Content of the same (wt %) | Other ceramics (wt %) | Metallic phase (wt %) | Carbon (wt %) | Blending amount of carbon black (wt %) |
|---|---|---|---|---|---|---|---|---|---|
| *1 | 80 | 5.0 | $MgTiO_3$ | 0.5 | *0.1 | 13.0 | 0.1 | 1.8 | 0.6 |
| 2 | 79 | 4.7 | " | 0.5 | 12 | 2.4 | 0.1 | 1.8 | 1.2 |
| 3 | 64 | 5.1 | " | 0.5 | 20 | 9.0 | 0.1 | 1.8 | 0.6 |
| 4 | 85 | 5.0 | " | 0.5 | 3 | 5.1 | 0.1 | 1.8 | 0.45 |
| *5 | 62 | 4.8 | " | 0.5 | *25 | 6.3 | 0.1 | 1.8 | 0.9 |
| 6 | 70 | 7.9 | " | 3.0 | 8 | 12.2 | 0.1 | 1.8 | 0.6 |
| 7 | 60 | 8.0 | " | 10 | 12 | 18.1 | 0.1 | 1.8 | 0.8 |
| 8 | 62 | 8.4 | " | 15 | 20 | 7.7 | 0.1 | 1.8 | 0.6 |
| 9 | 65 | 12.5 | " | 25 | 12 | 8.6 | 0.1 | 1.8 | 0.9 |
| 10 | 75 | 6.5 | $MgZrO_3$ | 3.0 | 6 | 10.9 | 0.1 | 1.5 | 0.8 |
| 11 | 75 | 6.5 | $BaTiO_3$ | 1.0 | 12 | 5.2 | 0.1 | 1.2 | 0.9 |
| 12 | 75 | 6.5 | $BaZrO_3$ | 3.0 | 8 | 8.9 | 0.1 | 1.5 | 0.6 |
| 13 | 75 | 6.5 | $CaTiO_3$ | 1.5 | 12 | 3.5 | 0.1 | 2.9 | 1.6 |
| 14 | 75 | 6.5 | $SrTiO_3$ | 1.0 | 8 | 6.8 | 0.1 | 3.6 | 1.8 |
| *15 | 75 | 6.5 | $TiO_2$ | 3.0 | 10 | 1.6 | 0.1 | 6.8 | 4.0 |

The mark * indicates that the sample No. is out of the scope of the invention.

TABLE 8

| Sample No. | Vitrification | Load life characteristic 100 hr | 200 hr | Radio frequency noise characteristic | Temperature characteristic | Specific electrical resistivity (Ω · cm) $\alpha_1$ 20° C. | $\alpha_2$ 150° C. | $\gamma = (\alpha_2 - \alpha_1)/\alpha_1$ |
|---|---|---|---|---|---|---|---|---|
| *1 | X | X | X | ○ | X | 460 | 280 | −0.391 |
| 2 | ○ | ○ | ○ | ◎ | ◎ | 430 | 330 | −0.233 |
| 3 | ○ | ○ | ○ | ◎ | ◎ | 1250 | 975 | −0.220 |
| 4 | ○ | ○ | ○ | ◎ | ◎ | 780 | 590 | −0.244 |
| *5 | ○ | ○ | X | ○ | ○ | 830 | 610 | −0.265 |
| 6 | ○ | ○ | ○ | ○ | ◎ | 460 | 350 | −0.239 |
| 7 | ○ | ○ | ○ | ◎ | ◎ | 520 | 400 | −0.231 |

TABLE 8-continued

| Sample No. | Vitrification | Load life characteristic 100 hr | Load life characteristic 200 hr | Radio frequency noise characteristic | Temperature characteristic | Specific electrical resistivity (Ω · cm) $\alpha_1$ 20° C. | $\alpha_2$ 150° C. | $\gamma = (\alpha_2 - \alpha_1)/\alpha_1$ |
|---|---|---|---|---|---|---|---|---|
| 8 | ○ | ○ | ○ | ◎ | ◎ | 480 | 370 | −0.229 |
| 9 | ○ | ○ | X | ◎ | ◎ | 630 | 490 | −0.222 |
| 10 | ○ | ○ | ○ | ◎ | ◎ | 480 | 380 | −0.208 |
| 11 | ○ | ○ | ○ | ◎ | ◎ | 400 | 320 | −0.200 |
| 12 | ○ | ○ | ○ | ◎ | ◎ | 100 | 78 | −0.220 |
| 13 | ○ | ○ | ○ | ◎ | ◎ | 320 | 240 | −0.250 |
| 14 | ○ | ○ | ○ | ◎ | ◎ | 90 | 69 | −0.233 |
| *15 | ○ | ○ | X | X | ○ | 300 | 210 | −0.300 |

The mark * indicates that the sample No. is out of the scope of the invention.

TABLE 9

| Sample No. | Content of coarse-particle glass (wt %) | Content of fine-particle glass (wt %) | Type of $Ti_2O_5$ or Ti | Mean particle size of the same (μm) | Content of the same (wt %) | $ZrO_2$ | Carbon (wt %) | Blending amount of carbon black (wt %) |
|---|---|---|---|---|---|---|---|---|
| 1 | 79.7 | 5.0 | $Ti_3O_5$ | 75 | 0.5 | 13.0 | 1.8 | 0.6 |
| 2 | 89.0 | 5.2 | $Ti_3O_5$ | 75 | 1.1 | 2.7 | 2.0 | 1.2 |
| 3 | 82.3 | 7.1 | $Ti_3O_5$ | 75 | 3.3 | 5.7 | 1.6 | 0.8 |
| 4 | 77.6 | 6.5 | $Ti_3O_5$ | 75 | 5.2 | 9.2 | 1.5 | 0.6 |
| 5 | 68.7 | 7.7 | $Ti_3O_5$ | 75 | 9.8 | 12.0 | 1.8 | 0.6 |
| 6 | 78.8 | 8.4 | $Ti_3O_5$ | 5 | 5.6 | 3.9 | 3.3 | 1.6 |
| 7 | 73.5 | 9.0 | $Ti_3O_5$ | 20 | 5.6 | 9.7 | 2.2 | 0.9 |
| 8 | 74.1 | 9.4 | $Ti_3O_5$ | 50 | 5.7 | 8.8 | 2.0 | 0.6 |
| 9 | 65.1 | 8.8 | $Ti_3O_5$ | 100 | 5.2 | 19.0 | 1.9 | 0.8 |
| 10 | 79.7 | 5.0 | Ti | 75 | 0.5 | 13.0 | 1.8 | 0.6 |
| 11 | 89.0 | 5.2 | Ti | 75 | 1.1 | 2.7 | 2.0 | 1.2 |
| 12 | 82.3 | 7.1 | Ti | 75 | 3.3 | 5.7 | 1.6 | 0.8 |
| 13 | 77.6 | 6.5 | Ti | 75 | 5.2 | 9.2 | 1.5 | 0.6 |
| 14 | 68.7 | 7.7 | Ti | 75 | 9.8 | 12.0 | 1.8 | 0.6 |
| 15 | 78.8 | 8.4 | Ti | 5 | 5.6 | 3.9 | 3.3 | 1.6 |
| 16 | 73.5 | 9.0 | Ti | 20 | 5.6 | 9.7 | 2.2 | 0.9 |
| 17 | 74.1 | 9.4 | Ti | 50 | 5.7 | 8.8 | 2.0 | 0.6 |
| 18 | 65.1 | 8.8 | Ti | 100 | 5.2 | 19.0 | 1.9 | 0.8 |
| *19 | 75.1 | 6.5 | $TiO_2$ | 3 | 10 | 1.6 | 6.8 | 4.0 |

The mark * indicates that the sample No. is out of the scope of the invention.

TABLE 10

| Sample No. | Vitrification | Load life characteristic 100 hr | Load life characteristic 200 hr | Radio frequency noise characteristic | Temperature characteristic | Specific electrical resistivity (Ω · cm) $\alpha_1$ 20° C. | $\alpha_2$ 150° C. | $\gamma = (\alpha_2 - \alpha_1)/\alpha_1$ |
|---|---|---|---|---|---|---|---|---|
| 1 | ○ | ○ | ○ | ○ | ○ | 450 | 348 | −0.227 |
| 2 | ○ | ○ | ○ | ○ | ○ | 430 | 328 | −0.237 |
| 3 | ○ | ○ | ○ | ○ | ○ | 480 | 374 | −0.221 |
| 4 | ○ | ○ | ○ | ○ | ○ | 520 | 401 | −0.229 |
| 5 | ○ | ○ | ○ | ○ | ○ | 510 | 395 | −0.225 |
| 6 | ○ | ○ | ○ | ○ | ○ | 530 | 405 | −0.236 |
| 7 | ○ | ○ | ○ | ◎ | ◎ | 490 | 390 | −0.204 |
| 8 | ○ | ○ | ○ | ◎ | ◎ | 570 | 459 | −0.195 |
| 9 | ○ | ○ | ○ | ○ | ◎ | 550 | 419 | −0.238 |
| 10 | ○ | ○ | ○ | ○ | ◎ | 510 | 392 | −0.231 |
| 11 | ○ | ○ | ○ | ○ | ◎ | 470 | 363 | −0.228 |
| 12 | ○ | ○ | ○ | ○ | ◎ | 550 | 421 | −0.235 |
| 13 | ○ | ○ | ○ | ○ | ◎ | 600 | 460 | −0.233 |
| 14 | ○ | ○ | ○ | ○ | ◎ | 510 | 397 | −0.222 |
| 15 | ○ | ○ | ○ | ○ | ◎ | 520 | 403 | −0.225 |
| 16 | ○ | ○ | ○ | ◎ | ◎ | 490 | 382 | −0.220 |
| 17 | ○ | ○ | ○ | ◎ | ◎ | 450 | 345 | −0.223 |
| 18 | ○ | ○ | ○ | ○ | ◎ | 530 | 409 | −0.228 |
| *19 | ○ | ○ | X | X | X | 470 | 364 | −0.226 |

The mark * indicates that the sample No. is out of the scope of the invention.

TABLE 11

| Sample No. | Content of coarse-particle glass (wt %) | Content of fine-particle glass (wt %) | Type of conductive material | Mean particle size of the same (μm) | Content of the same (wt %) | $ZrO_2$ | Oxygen in TiC or TiN (wt %) | Free carbon Wcp (wt %) | Blending amount of carbon black (wt %) |
|---|---|---|---|---|---|---|---|---|---|
| 1 | 75 | 10.5 | TiC | 2.0 | 0.7 | 12.0 | 1 | 1.8 | 0.7 |
| 2 | 75 | 10.1 | TiC | 0.7 | 1.2 | 12.0 | 3 | 1.7 | 0.6 |
| 3 | 75 | 10.0 | TiC | 5.0 | 1.2 | 12.0 | 1 | 1.8 | 0.7 |
| 4 | 75 | 10.0 | TiC | 6.0 | 1.2 | 12.0 | 4 | 1.8 | 0.9 |
| 5 | 70 | 11.3 | TiC | 2.0 | 5.0 | 12.0 | 1 | 1.7 | 0.6 |
| 6 | 70 | 11.2 | TiC | 2.0 | 5.0 | 12.0 | 3 | 1.8 | 0.7 |
| 7 | 70 | 11.2 | TiC | 2.0 | 5.0 | 12.0 | 4 | 1.8 | 0.9 |
| 8 | 65 | 12.3 | TiC | 0.7 | 9.0 | 12.0 | 1 | 1.7 | 0.6 |
| 9 | 65 | 12.2 | TiC | 5.0 | 9.0 | 12.0 | 3 | 1.8 | 0.7 |
| 10 | 65 | 12.2 | TiC | 6.0 | 9.0 | 12.0 | 4 | 1.8 | 0.9 |
| 11 | 65 | 10.7 | TiC | 2.0 | 10.5 | 12.0 | 1 | 1.8 | 0.7 |

TABLE 12

| Sample No. | Initial resistance | Rate of change of resistance after load life test | Radio frequency noise characteristic |
|---|---|---|---|
| 1 | 5.88 | +35 | ◎ |
| 2 | 5.86 | +8 | ◎ |
| 3 | 6.13 | −5 | ◎ |
| 4 | 5.72 | +30 | ◎ |
| 5 | 4.74 | −25 | ◎ |
| 6 | 4.83 | −21 | ◎ |
| 7 | 4.62 | +34 | ○ |
| 8 | 4.39 | −28 | ○ |
| 9 | 4.50 | −20 | ○ |
| 10 | 4.40 | +30 | ○ |
| 11 | 4.35 | −5 | Δ |

TABLE 14

| Sample No. | Initial resistance (kΩ) | Rat of change of resistance after load life test (ΔR:%) | Radio frequency noise characteristic |
|---|---|---|---|
| 12 | 5.80 | +35 | ◎ |
| 13 | 5.78 | +10 | ◎ |
| 14 | 5.91 | −4 | ◎ |
| 15 | 5.81 | +35 | ◎ |
| 16 | 5.52 | −26 | ◎ |
| 17 | 5.76 | −28 | ◎ |
| 18 | 5.65 | +34 | ○ |
| 19 | 4.12 | −24 | ○ |
| 20 | 4.38 | +21 | ○ |
| 21 | 4.21 | +35 | ○ |
| 22 | 4.20 | −7 | Δ |

TABLE 13

| Sample No. | Content of coarse-particle glass (wt %) | Content of fine-particle glass (wt %) | Type of conductive material | Mean particle size of the same (μm) | Content of the same (wt %) | $ZrO_2$ (wt %) | Oxygen in TiC or TiN (wt %) | Free carbon Wcp (wt %) | Blending amount of carbon black (wt %) |
|---|---|---|---|---|---|---|---|---|---|
| 12 | 75 | 10.5 | TiN | 2.5 | 0.7 | 12.0 | 1 | 1.8 | 0.7 |
| 13 | 75 | 10.1 | TiN | 1.0 | 1.2 | 12.0 | 1 | 1.7 | 0.6 |
| 14 | 75 | 10.0 | TiN | 5.0 | 1.2 | 12.0 | 3 | 1.8 | 0.7 |
| 15 | 75 | 10.0 | TiN | 6.0 | 1.2 | 12.0 | 4 | 1.8 | 0.9 |
| 16 | 70 | 11.3 | TiN | 2.5 | 5.0 | 12.0 | 1 | 1.7 | 0.6 |
| 17 | 70 | 11.2 | TiN | 2.5 | 5.0 | 12.0 | 3 | 1.8 | 0.7 |
| 18 | 70 | 11.2 | TiN | 2.5 | 5.0 | 12.0 | 4 | 1.8 | 0.9 |
| 19 | 65 | 12.3 | TiN | 1.0 | 9.0 | 12.0 | 1 | 1.7 | 0.6 |
| 20 | 65 | 12.2 | TiN | 5.0 | 9.0 | 12.0 | 3 | 1.8 | 0.7 |
| 21 | 65 | 12.2 | TiN | 6.0 | 9.0 | 12.0 | 4 | 1.8 | 0.9 |
| 22 | 65 | 10.7 | TiN | 2.5 | 10.5 | 12.0 | 1 | 1.8 | 0.7 |
| 23 | 72 | 10.2 | *1 | 12.0 | *1 | 1.8 | 0.7 | | |
| *2 24 | 72 | 10.0 | carbon black | 0.06 | 2.0 | 12.0 | — | 4.0 | 2.0 |

*1 2.0 wt % of TiC (2 μm $O_2$:1 wt %) and 2.0 wt % of TiN (2 μm $O_2$:2 wt %) were co-added.
*2 Indicates that the sample No. is out ot the scope of the invention.

TABLE 14-continued

| Sample No. | Initial resistance (kΩ) | Rat of change of resistance after load life test (ΔR:%) | Radio frequency noise characteristic |
|---|---|---|---|
| 23 | 5.20 | −3 | ○ |
| 24 | 5.08 | +45 | Δ |

TABLE 15

| Sample No. | Coarse-particle glass (wt %) | Fine-particle glass (wt %) | $ZrO_2$ (wt %) | Carbon black: Mean particle size (nm) | Carbon black: Structure length (ml/100 g) | Carbon black: Blending amount (wt %) | Variation in resistance (wt %) | Load life characteristic (wt %) | Apparent density of resistor (g/cm$^3$) |
|---|---|---|---|---|---|---|---|---|---|
| 1 | 64.6 | 5.8 | 10.8 | 10 | 40 | 18.8 | X | X | 0.82 |
| 2 | 72.4 | 6.5 | 12.1 | 10 | 60 | 9.0 | X | X | 1.03 |
| 3 | 73.8 | 6.7 | 12.3 | 10 | 120 | 7.2 | X | X | 1.05 |
| 4 | 75.4 | 6.8 | 12.6 | 10 | 140 | 5.2 | Δ | X | 1.10 |
| 5 | 64.0 | 5.8 | 10.7 | 20 | 40 | 19.5 | X | X | 0.80 |
| 6 | 71.6 | 6.5 | 12.0 | 20 | 60 | 9.9 | ○ | ○ | 1.01 |
| 7 | 73.1 | 6.6 | 12.2 | 20 | 120 | 8.1 | ○ | ○ | 1.05 |
| 8 | 74.6 | 6.7 | 12.4 | 20 | 140 | 6.3 | Δ | X | 1.10 |
| 9 | 62.9 | 5.6 | 10.5 | 40 | 40 | 21.0 | X | Δ | 0.80 |
| 10 | 70.2 | 6.3 | 11.7 | 40 | 60 | 11.8 | ○ | ○ | 1.00 |
| 11 | 72.4 | 6.5 | 12.1 | 40 | 120 | 9.0 | ○ | ○ | 1.03 |
| 12 | 73.8 | 6.7 | 12.3 | 40 | 140 | 7.2 | Δ | X | 1.05 |
| 13 | 61.8 | 5.6 | 10.3 | 60 | 40 | 22.3 | X | Δ | 0.75 |
| 14 | 69.6 | 6.3 | 11.6 | 60 | 60 | 12.5 | ○ | ○ | 0.99 |
| 15 | 70.9 | 6.4 | 11.8 | 60 | 120 | 10.9 | ○ | ○ | 1.00 |
| 16 | 73.1 | 6.6 | 12.2 | 60 | 140 | 8.1 | Δ | X | 1.05 |
| 17 | 61.3 | 5.5 | 10.2 | 80 | 40 | 23.0 | Δ | Δ | 0.70 |
| 18 | 68.3 | 6.2 | 11.4 | 80 | 60 | 14.1 | ◎ | ◎ | 0.95 |
| 19 | 69.6 | 6.3 | 11.6 | 80 | 120 | 12.5 | ○ | ○ | 0.99 |
| 20 | 71.6 | 6.5 | 12.0 | 80 | 140 | 9.9 | Δ | X | 1.01 |
| 21 | 59.8 | 5.4 | 10.0 | 100 | 40 | 24.8 | X | X | 0.67 |
| 22 | 65.2 | 5.9 | 10.8 | 100 | 60 | 18.1 | X | X | 0.82 |
| 23 | 66.4 | 6.0 | 11.0 | 100 | 120 | 16.6 | X | X | 0.90 |
| 24 | 68.3 | 6.2 | 11.4 | 100 | 140 | 14.1 | X | X | 0.95 |

What is claimed is:

1. A resistor-incorporated spark plug in which a through hole is formed along an axis of an insulator, a terminal is fixed to one end side of the through hole while a center electrode is fixed to the other end side of the through hole, and in which a resistor made of a resistor composition principally comprising a conductive material, glass particles and ceramic particles other than glass is placed between the terminal and the center electrode within the through hole, wherein the resistor composition contains, as the ceramic particles, semiconductive ceramic particles, and $(\alpha 2-\alpha 1)/\alpha 1 \geqq 0.30$ wherein a value of electric resistance measured between the terminal and the center electrode via the resistor is $\alpha 1$ at 20° C. and $\alpha 2$ at 150° C.

2. The resistor-incorporated spark plug according to claim 1, wherein the resistor composition contains, as the semiconductive ceramic particles, 0.5–20 weight % of $TiO_2$ particles whose mean particle size of a particle image obtained from observation of its cross-sectional structure falls within a range of 0.5–20 μm, the $TiO_2$ particles at least partly having a rutile type crystalline structure.

3. The spark plug according to claim 2, wherein 20 weight % or more of the $TiO_2$ particles in the resistor composition have the rutile type crystalline structure.

4. The spark plug according to claim 2, having a content ratio of the $TiO_2$ particles belonging to a particle size range of 0.05–0.5 μm is 20–80 weight %, and having a content ratio of the $TiO_2$ particles belonging to a particle size range of 2–8 μm is 80–20 weight %.

5. The resistor-incorporated spark plug according to claim 1, wherein the resistor composition contains, as the semiconductive ceramic particles, 0.5–20 weight % of at least either one of a semiconductive titanate base complex oxide and a semiconductive zirconate base complex oxide (hereinafter, referred to as specific complex oxide when generically designated).

6. The spark plug according to claim 5, wherein the specific complex oxide is at least either one of titanate of an alkali earth metal element and zirconate of an alkali earth metal element.

7. The spark plug according to claim 6, wherein the specific complex oxide is one kind or more selected from a group consisting of $MgTiO_3$, $MgZrO_3$, $CaTiO_3$, $CaZrO_3$, $SrTiO_3$, 4 $SrZrO_3$, $BaTiO_3$ and $BaZrO_3$.

8. The spark plug according to claim 5, wherein particles of the specific complex oxide in the resistor composition have a mean particle size of 0.5–20 μm.

9. The resistor-incorporated spark plug according to claim 2, wherein content of a remainder of the ceramic particles from which the $TiO_2$ particles or the specific complex oxide particles is 2–32 weight %.

10. The resistor-incorporated spark plug according to claim 2, wherein the conductive material contains a metallic phase principally comprising one kind or more selected from among Al, Mg, Ti, Zr and Zn, and a non-metallic conductive material.

11. The spark plug according to claim 2, wherein a content of a carbon component in the resistor composition is 0.5–5 weight %.

12. The resistor-incorporated spark plug according to claim 1, wherein the resistor composition contains at least either one of a metallic phase principally comprising Ti as the conductive material (hereinafter, referred to as Ti-based metallic phase) and titanium suboxide particles represented by a composition formula of $Ti_nO_{2n-1}$ as the semiconductive ceramic particles.

13. The resistor-incorporated spark plug according to claim 12, wherein total content of the Ti-based metallic phase and/or the titanium suboxide particles in the resistor composition is 0.5–10 weight %.

14. The resistor-incorporated spark plug according to claim 12, wherein the Ti-based metallic phase and/or the titanium suboxide particles have a mean particle size of 5 μm–100 μm.

15. The resistor-incorporated spark plug according to claim 12, wherein the titanium suboxide particles principally comprise at least any one of TiO, $Ti_2O_3$ and $Ti_3O_5$.

16. The resistor-incorporated spark plug according to claim 12, wherein the resistor composition comprises:

2–60 weight % of glass;

2–65 weight % of the ceramic particles and 0.1–7 weight % of carbon component.

17. A resistor-incorporated spark plug in which with respect to a through hole which is formed along an axis of an insulator, a terminal is fixed to one end side of the through hole while a center electrode is fixed to the other end side of the through hole, and in which a resistor is made of a resistor composition principally comprising a conductive material, glass particles and ceramic particles other than glass is placed between the terminal and the center electrode within the through hole, wherein the resistor composition is made principally of a resistor composition containing, as the ceramic particles, 0.5–20 weight % of $TiO_2$ particles having a mean particle size of 0.5–20 μm, and at least part of the $TiO_2$ particles in the resistor composition have a rutile type crystalline structure.

18. A resistor-incorporated spark plug in which a through hole is formed along an axis of an insulator, a terminal is fixed to one end side of the through hole while a center electrode is fixed to the other end side of the through hole, and in which a resistor is made of a resistor composition principally comprising a conductive material, glass particles and ceramic particles other than glass is placed between the terminal and the center electrode within the through hole, wherein the resistor composition contains, as the ceramic particles, 0.5–20 weight % of either one of a semiconductive titanate base complex oxide or a semiconductive zirconate base complex oxide.

19. A resistor-incorporated spark plug in which a through hole is formed along an axis of an insulator, a terminal is fixed to one end side of the through hole while a center electrode is fixed to the other end side of the through hole, and in which a resistor is made of a resistor composition principally comprising a conductive material, glass particles and ceramic particles other than glass is placed between the terminal and the center electrode within the through hole, wherein the resistor composition contains at least either one of a metallic phase composed principally of Ti as the conductive material and titanium suboxide particles represented by a composition formula of $Ti_nO_{2n-1}$ (where $n \geqq 1$) as the ceramic particles.

20. The spark plug according to claim 1, wherein the resistor composition has a specific electrical resistivity of 50–2000 Ω.cm at 20° C.

21. A resistor-incorporated spark plug in which a through hole is formed along an axis of an insulator, a terminal is fixed to one end side of the through hole while a center electrode is fixed to the other end side of the through hole, and in which a resistor made of a resistor is composition principally comprising a conductive material, glass particles and ceramic particles other than glass is placed between the terminal and the center electrode within the through hole, wherein the resistor composition contains at least one of TiC particles and TiN particles as a non-metallic conductive material.

22. The resistor-incorporated spark plug according to claim 21, wherein total content of the TiC particles and/or the TiN particles in the resistor composition is 1–10 weight %.

23. The resistor-incorporated spark plug according to claim 21, wherein the TiC particles and/or the TiN particles in the resistor composition have a mean particle size of not more than 5 μm in a particle image obtained from observation of its cross-sectional structure.

24. The resistor-incorporated spark plug according to claim 21, wherein TiC and/or TiN powder having an oxygen content of not more than 3 weight % is used as a material of the resistor composition.

25. The resistor-incorporated spark plug according to claim 21, wherein the resistor composition contains:

20–80 weight % of glass and

2–60 weight % of the ceramic particles.

* * * * *